US010739077B2

(12) United States Patent
Gerstler et al.

(10) Patent No.: US 10,739,077 B2
(45) Date of Patent: Aug. 11, 2020

(54) HEAT EXCHANGER INCLUDING FURCATING UNIT CELLS

(71) Applicant: General Electric Company, Schenectady, NY (US)

(72) Inventors: William Dwight Gerstler, Niskayuna, NY (US); Daniel Jason Erno, Clifton Park, NY (US); Michael Thomas Kenworthy, Beavercreek, OH (US); Jeffrey Douglas Rambo, Mason, OH (US); Nicolas Kristopher Sabo, West Chester, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 136 days.

(21) Appl. No.: 15/077,191

(22) Filed: Mar. 22, 2016

(65) Prior Publication Data

US 2016/0202003 A1 Jul. 14, 2016

Related U.S. Application Data

(63) Continuation-in-part of application No. PCT/US2015/054115, filed on Oct. 6, 2015.

(Continued)

(51) Int. Cl.
*F28D 7/00* (2006.01)
*F28F 13/06* (2006.01)

(Continued)

(52) U.S. Cl.
CPC ..... *F28D 7/0008* (2013.01); *F28D 9/00* (2013.01); *F28D 9/0012* (2013.01); *F28D 9/02* (2013.01);

(Continued)

(58) Field of Classification Search
CPC ..... F28F 13/06; F28F 7/02; F28F 9/02; F28F 9/0229; F28F 13/00; F28F 13/02;

(Continued)

(56) References Cited

U.S. PATENT DOCUMENTS 3,228,464 A 1/1966 Stein et al.
3,548,932 A * 12/1970 Menkus ..... F28F 3/02 165/165

(Continued)

FOREIGN PATENT DOCUMENTS

CN 102721303 B 4/2014
EP 1777479 A2 4/2007

(Continued)

OTHER PUBLICATIONS

Biswas (Heat transfer and flow structure in laminar and turbulent flows in a rectangular channel with longitudinal vortices) (Year: 1994).*

(Continued)

*Primary Examiner* — Gordon A Jones
(74) *Attorney, Agent, or Firm* — Christopher R. Carroll; The Small Patent Law Group, LLC

(57) ABSTRACT

A heat exchanger includes a core defining a first passageway configured for a first fluid to flow through and a second passageway configured for a second fluid to flow through. The core includes a plurality of unit cells coupled together. Each unit cell of the plurality of unit cells includes a sidewall at least partly defining a first passageway portion, a second passageway portion, a plurality of first openings for the first fluid to flow through, and a plurality of second openings for the second fluid to flow through. Each unit cell of the plurality of unit cells is configured to enable the first fluid to combine and divide in the first passageway portion. Each (Continued)

unit cell is further configured to enable the second fluid to combine and divide in the second passageway portion.

20 Claims, 14 Drawing Sheets

Related U.S. Application Data

(60) Provisional application No. 62/060,719, filed on Oct. 7, 2014.

(51) Int. Cl.

| | |
|---|---|
| ***F28D 9/00*** | (2006.01) |
| ***F28D 9/02*** | (2006.01) |
| ***F28F 13/00*** | (2006.01) |
| ***F28F 9/02*** | (2006.01) |
| ***F28F 7/02*** | (2006.01) |
| ***F28F 13/02*** | (2006.01) |
| ***F28F 21/08*** | (2006.01) |
| *F28D 21/00* | (2006.01) |

(52) U.S. Cl.
CPC ..... *F28F 7/02* (2013.01); *F28F 9/02* (2013.01); *F28F 9/0229* (2013.01); *F28F 9/0275* (2013.01); *F28F 13/00* (2013.01); *F28F 13/02* (2013.01); *F28F 13/06* (2013.01); *F28F 21/084* (2013.01); *F28F 21/086* (2013.01); *F28D 2021/0026* (2013.01); *F28F 2009/029* (2013.01); *F28F 2210/02* (2013.01); *F28F 2250/102* (2013.01)

(58) Field of Classification Search
CPC ..... F28F 2009/029; F28F 2210/02; F28F 9/0275; F28F 21/084; F28F 21/086; F28F 2250/102; F02C 7/14; F28D 7/0008; F28D 9/00; F28D 9/0012; F28D 9/02; F28D 2021/0026
See application file for complete search history.

(56) References Cited

U.S. PATENT DOCUMENTS

| | | | | |
|---|---|---|---|---|
| 4,149,591 | A * | 4/1979 | Albertsen | F28F 7/02 165/165 |
| 4,343,354 | A * | 8/1982 | Weber | F28F 7/02 165/165 |
| 4,784,218 | A * | 11/1988 | Holl | F28F 13/02 138/38 |
| 4,915,164 | A | 4/1990 | Harper, Jr. | |
| 5,941,303 | A | 8/1999 | Gowan et al. | |
| 6,877,552 | B1 * | 4/2005 | King | F28D 7/024 165/159 |
| 7,044,207 | B1 * | 5/2006 | Guidat | F28D 9/0006 165/166 |
| 7,069,980 | B2 | 7/2006 | Hofbauer | |
| 7,866,377 | B2 | 1/2011 | Slaughter | |
| 7,871,578 | B2 | 1/2011 | Schmidt | |
| 8,015,832 | B2 | 9/2011 | Setoguchi et al. | |
| 8,235,101 | B2 | 8/2012 | Taras et al. | |
| 8,240,365 | B2 * | 8/2012 | Obana | F28D 7/0041 165/144 |
| 8,794,820 | B2 | 8/2014 | Mathys et al. | |
| 9,134,072 | B2 | 9/2015 | Raisin et al. | |
| 2005/0006064 | A1 * | 1/2005 | Garimella | F25B 37/00 165/117 |
| 2005/0016721 | A1 * | 1/2005 | Antonijevic | B60H 1/00571 165/177 |
| 2008/0149299 | A1 | 6/2008 | Slaughter | |
| 2010/0270011 | A1 | 10/2010 | Takahashi et al. | |
| 2013/0139541 | A1 | 6/2013 | Seybold et al. | |
| 2013/0206374 | A1 | 8/2013 | Roisin et al. | |
| 2013/0276469 | A1 | 10/2013 | Dryzun | |
| 2013/0277021 | A1 * | 10/2013 | Huebel | F25J 5/002 165/157 |
| 2014/0014493 | A1 | 1/2014 | Ryan | |
| 2014/0251585 | A1 * | 9/2014 | Kusuda | F28D 1/06 165/164 |
| 2015/0010874 | A1 | 1/2015 | Ghazvini et al. | |
| 2016/0116218 | A1 * | 4/2016 | Shedd | G06F 1/206 165/133 |
| 2016/0116222 | A1 * | 4/2016 | Shedd | G06F 1/206 165/166 |
| 2017/0248372 | A1 * | 8/2017 | Erno | F28D 7/0008 |

FOREIGN PATENT DOCUMENTS

| | | | |
|---|---|---|---|
| EP | 1837616 | A2 | 9/2007 |
| GB | 2310896 | A | 9/1997 |
| WO | 3192788 | A1 | 12/2001 |
| WO | 2011115883 | A2 | 9/2011 |
| WO | 2014105113 | A1 | 7/2014 |

OTHER PUBLICATIONS

Jungwon Ahn (Fundamental Studies of Crossflow Heat Exchangers for Laminar and Turbulent Flows) (Year: 2017).*
Dejong (Flow, Heat Transfer, and Pressure Drop Interactions in Louvered-Fin Arrays) (Year: 1999).*
Silva et al., "Constructal multi-scale tree-shaped heat exchangers", Journal of Applied Physics, vol. 96, Issue: 3, 2004.
Kim et al., "Two-phase flow distribution of air-water annular flow in a parallel flow heat exchanger", International Journal of Multiphase Flow, vol. 32, Issue: 12, pp. 1340-1353, Dec. 2006.
International Search Report and Written Opinion, dated Jan. 22, 2016, for International Application No. PCT/US2015/054115.
Partial European Search Report and Opinion issued in connection with corresponding EP Application No. 17162283.0 dated Oct. 26, 2017.

* cited by examiner

HEAT EXCHANGER INCLUDING FURCATING UNIT CELLS

CROSS REFERENCE TO RELATED APPLICATIONS

This application is a continuation-in-part of International Patent Application Serial Number PCT/US2015/054115, entitled "MULTI-BRANCH FURCATING FLOW HEAT EXCHANGER", which was filed on Oct. 6, 2015, and which claims the priority of provisional Patent Application Ser. No. 62/060,719 entitled "MULTI-BRANCH FURCATING FLOW HEAT EXCHANGER", which was filed on Oct. 7, 2014, and which is hereby incorporated by reference in its entirety.

BACKGROUND

The present disclosure relates generally to heat exchangers and, more specifically, heat exchangers including unit cells forming furcating flow passageways.

At least some known heat exchangers utilize heat transfer fluids that flow through the heat exchangers and transfer heat. A heat transfer efficiency of the heat exchangers is determined, at least in part, by the flow of the heat transfer fluids through the heat exchangers. As the heat transfer fluids flow through the heat exchangers, the heat transfer fluids tend to establish a boundary layer which increases thermal resistance and reduces the heat transfer efficiency of the heat exchangers. In addition, the heat transfer efficiency of the heat exchangers is affected by characteristics of the heat exchanger such as material properties, surface areas, flow configurations, pressure drops, and resistivity to thermal exchange. Improving any of these characteristics allows the heat exchanger to have an increased heat transfer efficiency.

In addition, some systems or applications require heat exchangers to fit within a specified system volume and weigh less than a specified weight. However, reducing the size of the heat exchangers to meet system requirements affects the characteristics that determine heat transfer efficiency. Also, at least some heat exchangers are not properly shaped to fit within the systems, which results in ineffective use of space and/or wasted volume. Moreover, at least some known heat exchangers are formed to meet system requirements using fabrication techniques that require multiple joints, such as brazed and welded joints. Such joints may deteriorate over time, thereby decreasing a service life of the heat exchangers.

BRIEF DESCRIPTION

In one aspect, a heat exchanger is provided. The heat exchanger includes a core defining a first passageway configured for a first fluid to flow through and a second passageway configured for a second fluid to flow through. The core includes a plurality of unit cells coupled together. Each unit cell of the plurality of unit cells includes a sidewall at least partly defining a first passageway portion, a second passageway portion, a plurality of first openings for the first fluid to flow through, and a plurality of second openings for the second fluid to flow through. Each unit cell of the plurality of unit cells is configured to enable the first fluid to combine and divide in the first passageway portion. Each unit cell is further configured to enable the second fluid to combine and divide in the second passageway portion.

In another aspect, a heat exchanger is provided. The heat exchanger includes a core defining a first passageway for a first fluid to flow through and a second passageway for a second fluid to flow through. The core includes a first unit cell, a second unit cell, and a third unit cell. The first unit cell includes a first sidewall at least partially defining a first passageway first portion and a second passageway first portion. The second unit cell includes a second sidewall at least partially defining a first passageway second portion and a second passageway second portion. The second unit cell is coupled to the first unit cell. The third unit cell includes a third sidewall at least partially defining a first passageway third portion and a second passageway third portion. The third unit cell is coupled to the first unit cell. The first unit cell is configured to enable the first fluid to flow from the first passageway first portion to the first passageway second portion and the first passageway third portion. In addition, the first unit cell is further configured to enable the second fluid to flow into the second passageway first portion from the second passageway second portion and the second passageway third portion.

DRAWINGS

These and other features, aspects, and advantages of the present disclosure will become better understood when the following detailed description is read with reference to the accompanying drawings in which like characters represent like parts throughout the drawings, wherein.

Figure 1:
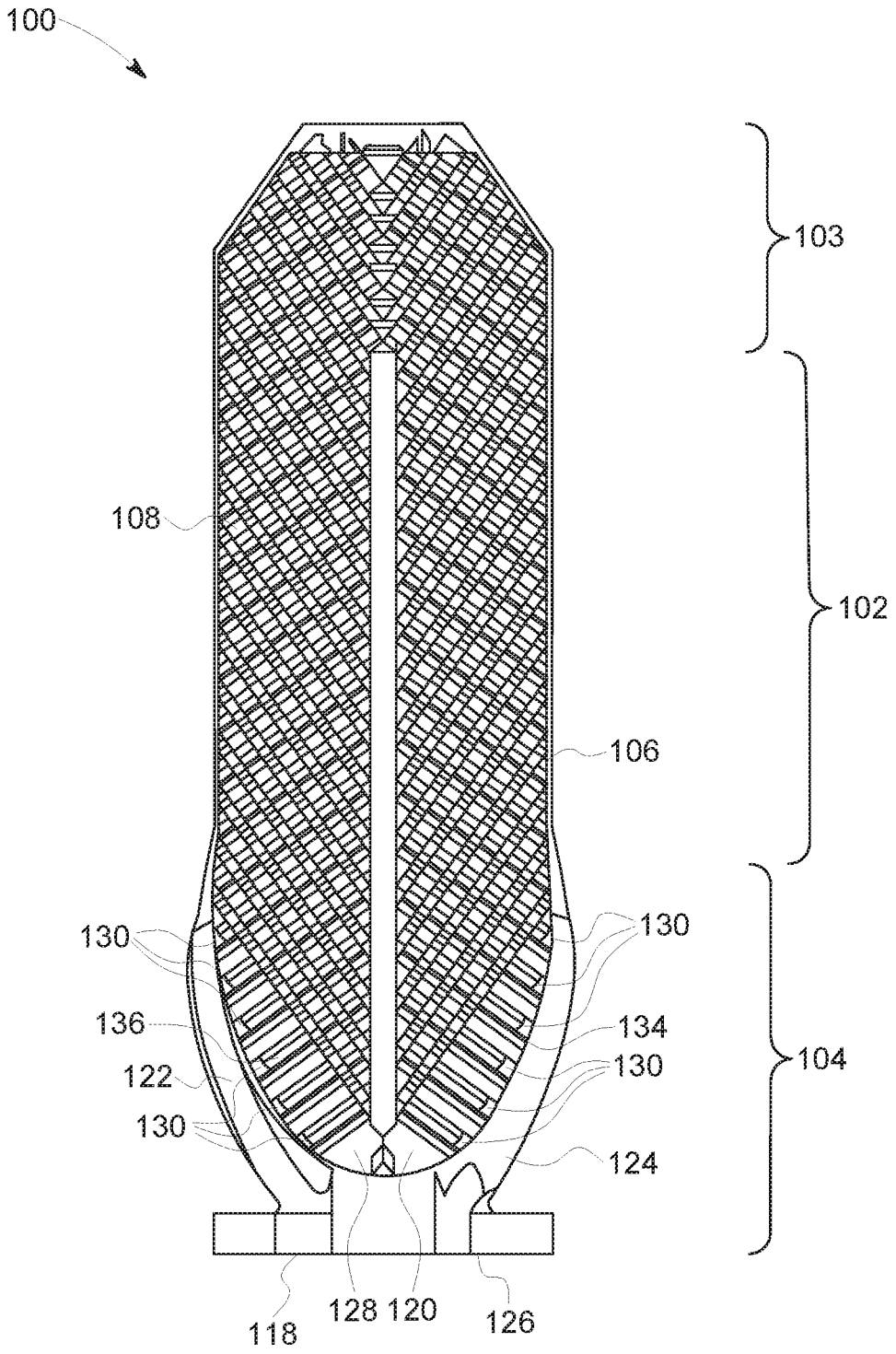
FIG. 1 is a schematic sectional view of an exemplary heat exchanger.

Unless otherwise indicated, the drawings provided herein are meant to illustrate features of embodiments of the disclosure. These features are believed to be applicable in a wide variety of systems including one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "substantially," and "approximately," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the terms "axial" and "axially" refer to directions and orientations that extend substantially parallel to a centerline of the heat exchanger. Moreover, the terms "radial" and "radially" refer to directions and orientations that extend substantially perpendicular to the centerline of the heat exchanger. In addition, as used herein, the terms "circumferential" and "circumferentially" refer to directions and orientations that extend arcuately about the centerline of the heat exchanger. It should also be appreciated that the term "fluid" as used herein includes any medium or material that flows, including, but not limited to, air, gas, liquid, and steam.

The systems and methods described herein include a core that enables heat exchangers to have different shapes, sizes, and flow configurations. The core includes a plurality of unit cells. The unit cells define passageways for at least two different heat exchange fluids such that the fluids combine and divide in close proximity separated only by a sidewall of the unit cell. In some embodiments, each unit cell is configured to receive flows of heat exchange fluid from at least three other unit cells such that the flows combine into a single flow. In addition, each unit cell forms a trifurcated passageway portion such that the flow divides and is discharged into at least three other unit cells. As a result, the thermal boundary layers of the heat exchange fluids are reduced and the heat exchange fluids more efficiently transfer heat through the sidewalls of the unit cells in comparison to heat exchange fluids in known heat exchangers. Moreover, the heat exchangers described herein include multiple arrangements and flow configurations to meet overall system requirements and have increased efficiency.

Figure 2:
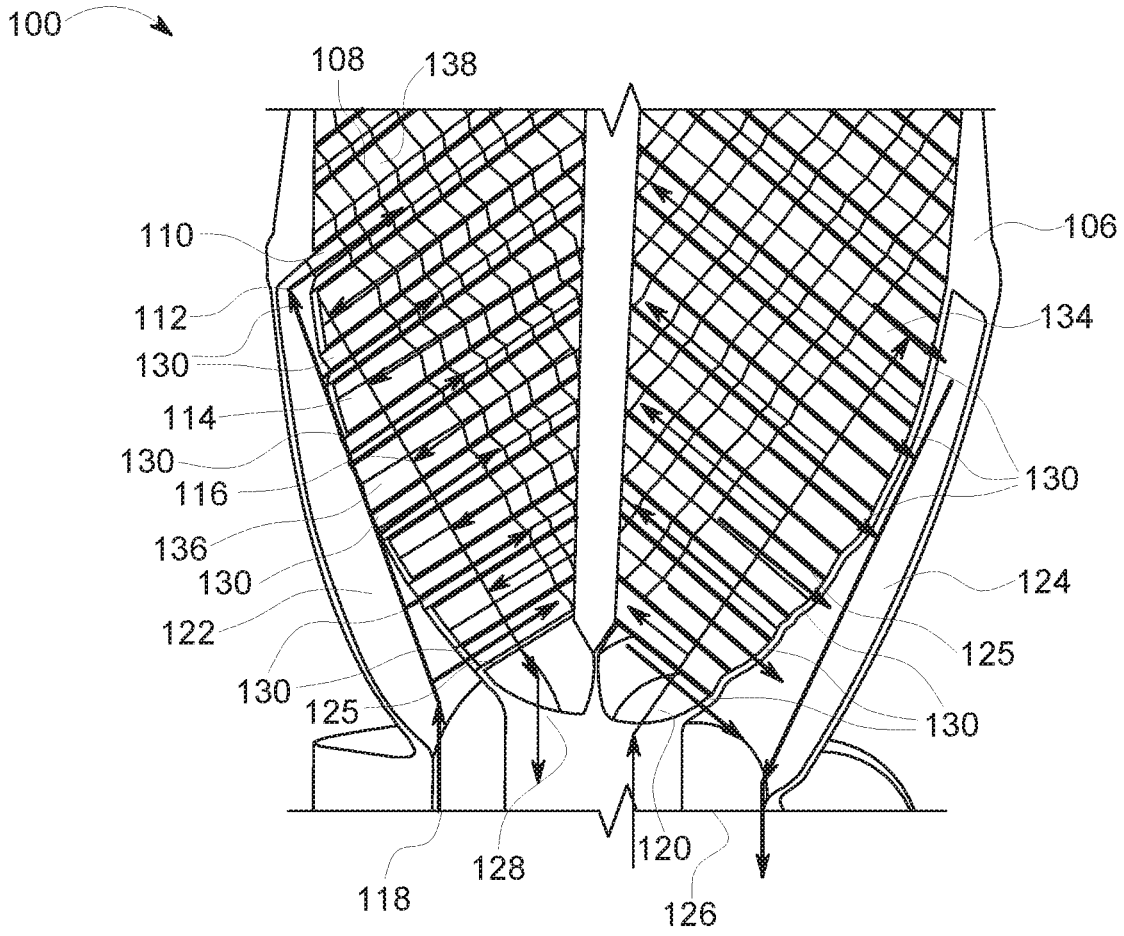
FIG. 2 is a schematic view of a portion of the heat exchanger shown in FIG. 1.

FIG. 1 is a sectional view of an exemplary heat exchanger 100. FIG. 2 is a partially schematic view of a portion of heat exchanger 100. Heat exchanger 100 includes a core 102, a redirection portion 103, a manifold portion 104, and a casing 106. Each of manifold portion 104, core 102, and redirection portion 103 includes a plurality of unit cells 108 defining a first passageway 110 for a first fluid 112 to flow through and a second passageway 114 for a second fluid 116 to flow through. In redirection portion 103, first fluid 112 and second fluid 116 are redirected by unit cells 108. Specifically, first fluid 112 and second fluid 116 are turned approximately 180° in redirection portion 103. In alternative embodiments, heat exchanger 100 has any configuration that enables heat exchanger 100 to operate as described herein. For example, in some embodiments, at least a portion of first fluid 112 and/or second fluid 116 is replaced with an at least partially solid substance configured to accommodate thermal shocks, such as wax, fusible alloy and/or molten salt.

In the exemplary embodiment, manifold portion 104 includes a first inlet 118, a second inlet 120, an inlet header 122, an outlet header 124, a first outlet 126, and a second outlet 128. In alternative embodiments, manifold portion 104 has any configuration that enables heat exchanger 100 to operate as described herein. For example, in some embodiments, manifold portion 104 includes a plurality of first inlets 118, second inlets 120, inlet headers 122, outlet headers 124, first outlets 126, and/or second outlets 128. In further embodiments, heat exchanger 100 includes a plurality of manifold portions 104 coupled to core 102.

In the exemplary embodiment, each of inlet header 122 and outlet header 124 include a plurality of ports 130 in fluid communication with first passageway 110. Inlet header 122 and outlet header 124 change in cross-sectional area along the direction of flow of first fluid 112 to accommodate the differing volume of first fluid 112 in inlet header 122 and outlet header 124 due to first fluid 112 flowing through ports 130. Specifically, inlet header 122 tapers in cross-sectional area from a maximum cross-sectional area adjacent first inlet 118 to a minimum cross-sectional area adjacent a distal end of inlet header 122. Outlet header 124 increases in cross-sectional area from a minimum cross-sectional area adjacent a distal end of outlet header 124 to a maximum cross-sectional area adjacent first outlet 126. Ports 130 are substantially bell-shaped to facilitate smooth fluid flow through ports 130 and to minimize irreversible flow losses. In alternative embodiments, heat exchanger 100 includes any inlet header 122 and outlet header 124 that enables heat exchanger 100 to operate as described herein. For example, in some embodiments, heat exchanger 100 includes a plurality of inlet headers 122 and outlet headers 124. In further embodiments, at least one inlet header 122 and/or outlet header 124 is coupled to second passageway 114.

In the exemplary embodiment, core 102 further includes an inlet plenum 134 and an outlet plenum 136. Inlet plenum 134 and outlet plenum 136 are in fluid communication with second passageway 114. Inlet plenum 134 is coupled to second inlet 120 and outlet plenum 136 is coupled to second outlet 128. Inlet plenum 134 and outlet plenum 136 are adjacent inlet header 122 and outlet header 124 to facilitate first fluid 112 and second fluid 116 exchanging heat as first fluid 112 and second fluid 116 flow into and out of core 102. Moreover, a plurality of conduits 125 are coupled to inlet header 122 and outlet header 124 and extend through inlet plenum 134 and outlet plenum 136. In alternative embodiments, heat exchanger 100 includes any inlet plenums 134 and outlet plenums 136 that enable heat exchanger 100 to operate as described herein.

Also, in the exemplary embodiment, core 102 is manufactured using an additive manufacturing process. An additive manufacturing process allows core 102 to have complex geometries while limiting the number of joints of core 102. In alternative embodiments, core 102 is formed in any manner that enables heat exchanger 100 to operate as described herein.

During operation of heat exchanger 100, first fluid 112 flows into inlet header 122 through first inlet 118 and is distributed into first passageway 110 through ports 130. First fluid 112 in first passageway 110 is directed through core 102, redirection portion 103, and manifold portion 104. After flowing through first passageway 110, first fluid 112 flows through ports 130 into outlet header 124 and is discharged from heat exchanger 100 through first outlet 126. Second fluid 116 flows into inlet plenum 134 through second inlet 120 and is distributed into second passageway 114. Second fluid 116 in second passageway 114 is directed through core 102, redirection portion 103, and manifold portion 104. After flowing through second passageway 114, second fluid 116 flows into outlet plenum 136 where second fluid 116 is discharged from heat exchanger 100 through second outlet 128.

In alternative embodiments, heat exchanger 100 includes any passageways that enable heat exchanger 100 to operate as described herein. For example, in some embodiments, heat exchanger 100 includes at least one bypass passageway (not shown) to enable first fluid 112 and/or second fluid 116 to bypass at least a portion of first passageway 110 and/or second passageway 114. The bypass passageway (not shown) extends through any portions of heat exchanger 100, e.g., through core 102, redirection portion 103, manifold portion 104, and/or along an external periphery of heat exchanger 100. As a result, the bypass passageway (not shown) facilitates management of pressure drop due to excess amounts of first fluid 112 and/or second fluid 116.

Moreover, in the exemplary embodiment, core 102 is configured such that first fluid 112 and second fluid 116 exchange heat as first fluid 112 and second fluid 116 flow through core 102, redirection portion 103, and manifold portion 104. For example, as shown in FIG. 2, first fluid 112 and second fluid 116 exchange heat through sidewalls of unit cells 108 as first fluid 112 and second fluid 116 flow through portions of first passageway 110 and second passageway 114 defined by unit cells 108. As will be described in more detail below, unit cells 108 define portions of first passageway 110 and second passageway 114 where first fluid 112 and second fluid 116 combine and divide to disrupt thermal boundary layers in first fluid 112 and second fluid 116. In the exemplary embodiment, unit cells 108 are aligned and coupled together such that core 102 is substantially symmetrical, which facilitates multiple flow configurations of heat exchanger 100. For example, in the illustrated embodiment, core 102 has a diamond shape. In alternative embodiments, core 102 has any configuration that enables heat exchanger 100 to operate as described herein.

In some embodiments, core 102 is divided up into independent zones. Unit cells 108 facilitate sectioning and/or segmenting core 102 into the independent zones. In further embodiments, heat exchanger 100 includes a plurality of discrete cores 102. The repeating geometric shapes of unit cells 108 facilitate core 102 coupling to other cores 102 in multiple different configurations. In some embodiments, heat exchanger 100 includes a segment (not shown) linking separate cores 102 such that a portion of fluid flows through the segment between cores 102.

Figure 3:
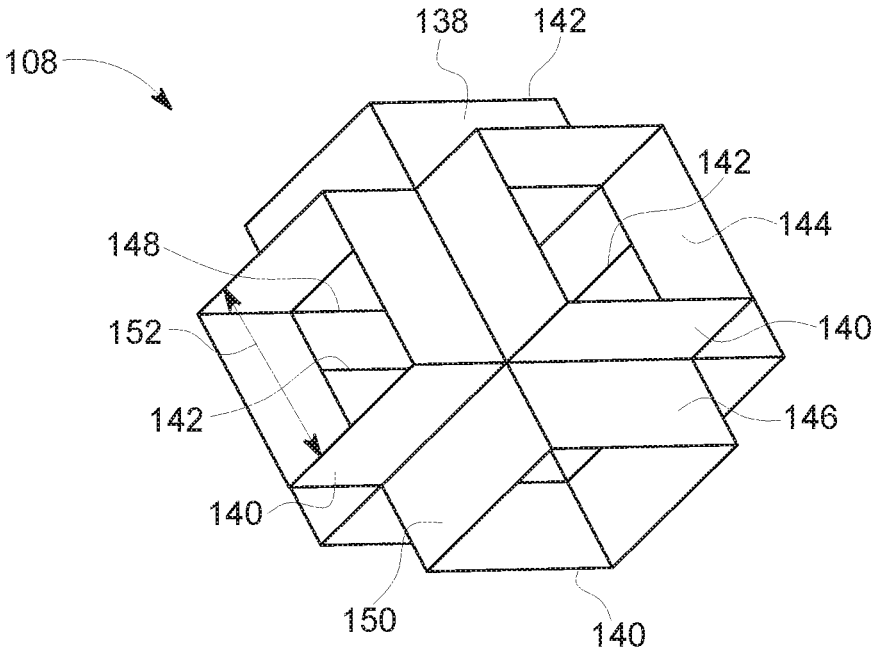
FIG. 3 is a schematic isometric view of a unit cell of the heat exchanger shown in FIG. 1.
Figure 4:
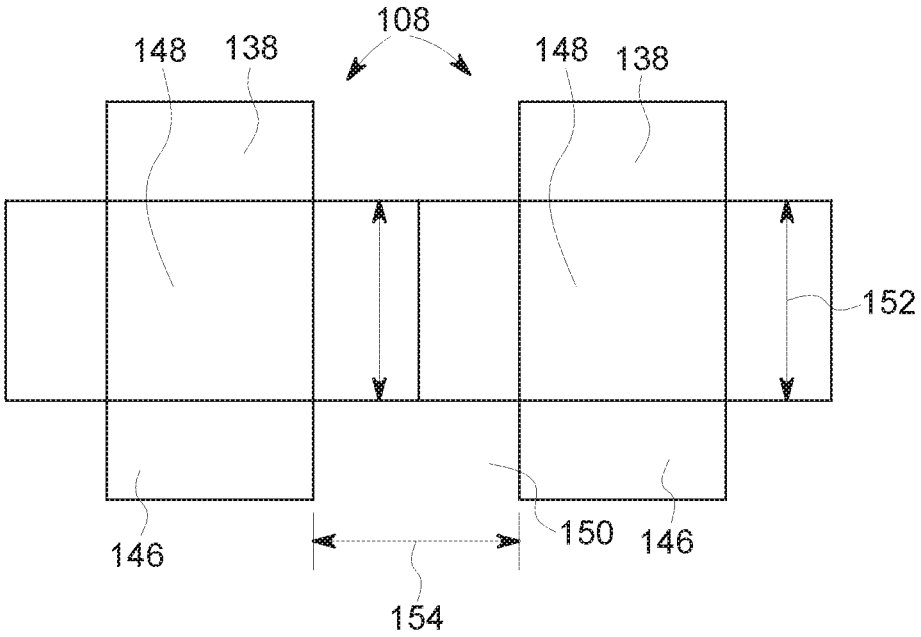
FIG. 4 is a schematic side view of a plurality of the unit cells shown in FIG. 3.

FIG. 3 is a schematic isometric view of unit cell 108. FIG. 4 is a schematic side view of a plurality of unit cells 108. In some embodiments, core 102 includes some unit cells 108 that differ in some aspects from unit cells 108 shown in FIGS. 3 and 4. In the exemplary embodiment, each unit cell 108 includes a sidewall 138 defining a plurality of unit cell inlets 140, a plurality of unit cell outlets 142, an interior surface 144, and an exterior surface 146. First fluid 112 flows into unit cell 108 through unit cell inlets 140, contacts interior surface 144, and flows out of unit cell 108 through unit cell outlets 142. Second fluid 116 flows past unit cell 108 such that second fluid 116 contacts exterior surface 146. In the illustrated embodiment, each unit cell 108 has three unit cell inlets 140 and three unit cell outlets 142. In alternative embodiments, unit cell 108 has any unit cell inlets 140 and unit cell outlets 142 that enable heat exchanger 100 to operate as described herein.

Also, in the exemplary embodiment, each unit cell 108 forms a first passageway portion 148 of first passageway 110 and a second passageway portion 150 of second passageway 114. First passageway portion 148 and second passageway portion 150 are configured for first fluid 112 and second fluid 116 to exchange thermal energy through sidewall 138. In operation, first fluid 112 flows into first passageway portion 148 from other first passageway portions 148 associated with other unit cells 108. First passageway portion 148 furcates such that first fluid 112 flows out of first passageway portion 148 towards further first passageway portions 148. In particular, first passageway portion 148 trifurcates such that first fluid 112 flows into three flow paths towards three different first passageway portions 148. Second fluid 116 flows into second passageway portion 150 from other second passageway portions 150. Second passageway portion 150 furcates such that second fluid 116 flows out of second passageway portion 150 towards further second passageway portions 150. In particular first passageway portion 148 trifurcates such that second fluid 116 flows into three flow paths towards three different second passageway portions 150. First passageway portion 148 and second passageway portion 150 furcate at an approximately 90° angle. In alternative embodiments, first passageway portion 148 and second passageway portion 150 furcate at any angles that enable heat exchanger 100 to operate as described herein.

The furcated shapes of first passageway portion 148 and second passageway portion 150 provide for additional surface area to facilitate heat exchange between first fluid 112 and second fluid 116. Moreover, the furcation of unit cells 108 reduces and/or inhibits the formation of thermal boundary layers in first fluid 112 and second fluid 116. For example, thermal and momentum boundary layers are broken up each time first fluid 112 and second fluid 116 are redirected due to unit cells 108 furcating. Moreover, the repeated furcation in unit cells 108 inhibit first fluid 112 and second fluid 116 from establishing significant thermal and momentum boundary layers. In alternative embodiments, first passageway portion 148 and second passageway portion 150 have any configuration that enables heat exchanger 100 to operate as described herein.

In addition, in the exemplary embodiment, first passageway portion 148 has a first hydraulic diameter 152 and second passageway portion 150 has a second hydraulic diameter 154. First hydraulic diameter 152 and second hydraulic diameter 154 are determined based on flow requirements, such as flow rate, pressure drop, and heat transfer, and/or volume requirements for heat exchanger 100. Unit cell 108 forms first passageway portion 148 such that first hydraulic diameter 152 is approximately equal to the width of unit cell inlet 140. Second passageway portion 150 is formed by multiple unit cells 108. Accordingly, unit cell 108 spans only a portion of second hydraulic diameter 154. In the illustrated embodiment, unit cell 108 spans approximately half of second hydraulic diameter 154. Moreover, in the exemplary embodiment, first hydraulic diameter 152 is approximately equal to second hydraulic diameter 154. In alternative embodiments, first passageway portion 148 and second passageway portion 150 have any hydraulic diameters that enable heat exchanger 100 to operate as described herein. For example, in some embodiments, first hydraulic diameter 152 and second hydraulic diameter 154 are different from each other. In further embodiments, first hydraulic diameter 152 is greater than second hydraulic diameter 154 such that a ratio of first hydraulic diameter 152 to second hydraulic diameter 154 is at least 2:1.

Moreover, in the exemplary embodiment, first passageway portion 148 and second passageway portion 150 have a square cross-sectional shape. In alternative embodiments, first passageway portion 148 and second passageway portion 150 have any cross-sectional shape that enables heat exchanger 100 to operate as described herein. For example, in some embodiments, first passageway portion 148 and/or second passageway portion 150 have any of the following cross-sectional shapes, without limitation: rectangular, diamond, circular, and triangular. Moreover, in some embodiments, first passageway portion 148 and/or second passageway portion 150 include any of the following, without limitation: a fin, a surface having engineered roughness, a surface roughened by manufacturing process, any other heat transfer enhancement, and combinations thereof.

In the exemplary embodiment, the shape and size of unit cells 108 is determined based at least in part on any of the following, without limitation: surface area, pressure drop, compactness of core 102, and fluid flow. In the exemplary embodiment, unit cells 108 have substantially the same shape. In particular, unit cells 108 have a partially cuboid shape. In alternative embodiments, core 102 includes any unit cells 108 that enable heat exchanger 100 to operate as described herein. In some embodiments, core 102 includes unit cells 108 that differ in configuration from each other. In further embodiments, the shape of unit cells 108 at least partially conforms to a shape of core 102. For example, in some embodiments, unit cells 108 are at least partially curved to align with an annular shape of core 102.

In some embodiments, at least a portion of unit cells 108 are flexible to facilitate unit cells 108 shifting in response to characteristics of first fluid 112 and/or second fluid 116 such as pressure, flow rate, volume, and density. For example, in some embodiments, sidewalls 138 are flexible and adjust to attenuate fluid surge. In further embodiments, unit cells 108 are flexible such that first fluid 112 causes first passageway 110 to expand and at least partially propel second fluid 116 through second passageway 114. In the exemplary embodiment, sidewalls 138 of unit cells 108 are substantially rigid. In alternative embodiments, unit cells 108 have any amount of flexibility that enables heat exchanger 100 to operate as described herein.

Figure 5:
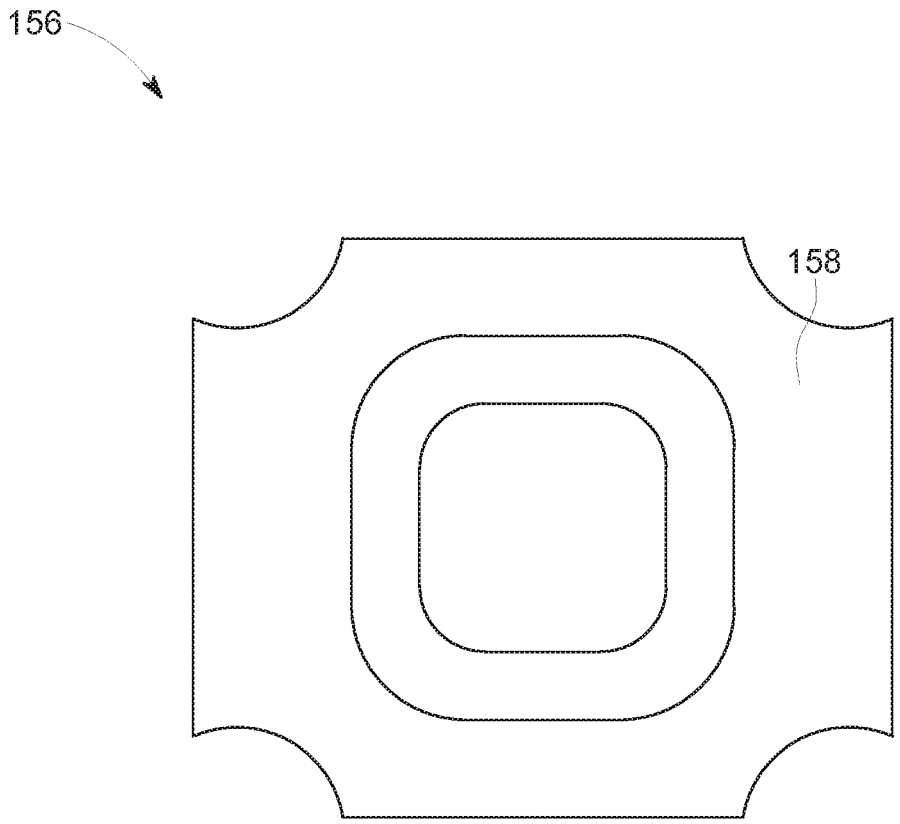
FIG. 5 is a schematic side view of an exemplary unit cell for use in the heat exchanger shown in FIG. 1
Figure 6:
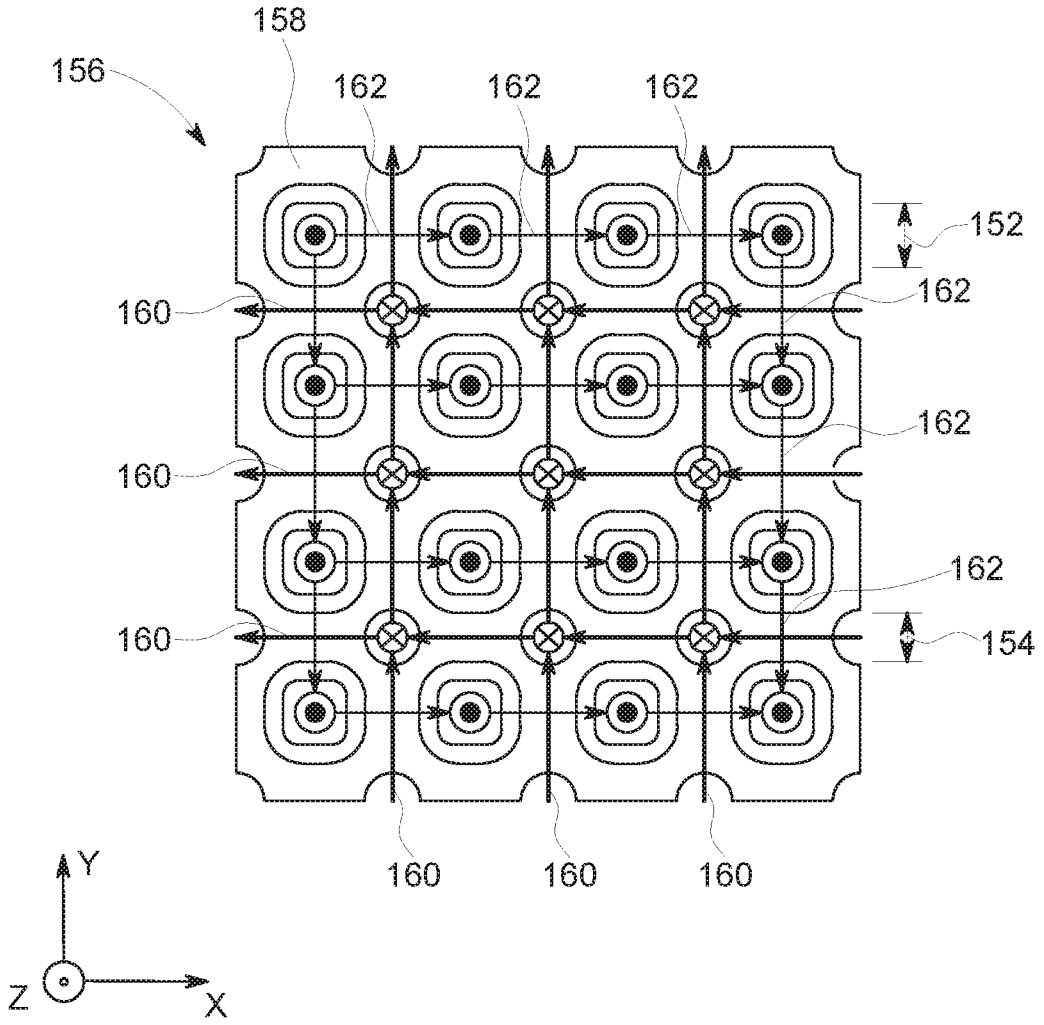
FIG. 6 is a schematic view of fluid flow through a plurality of the unit cells shown in FIG. 5.

FIG. 5 is a schematic side view of a unit cell 156 for use in the heat exchanger 100. FIG. 6 is a schematic view of fluid flow through a plurality of unit cells 156. Unit cell 156 includes a sidewall 158 at least partially defining first passageway portion 148 and second passageway portion 150. First passageway portion 148 has first hydraulic diameter 152 and second passageway portion 150 has second hydraulic diameter 154. Unit cells 156 are configured such that first hydraulic diameter 152 is different than second hydraulic diameter 154. In addition, sidewall 158 is at least partially curved such that first passageway portion 148 and second passageway portion 150 form blended flow passageways. In particular, the edges of sidewall 158 are blended to facilitate smooth fluid flow. The hydrodynamic shape of first passageway portion 148 and second passageway portion 150 reduces pressure drop due to changes in direction of first fluid 112 and second fluid 116. In alternative embodiments, core 102 includes any unit cells 156 that enable heat exchanger 100 to operate as described herein. In some embodiments, unit cell 156 incorporates minimal surfaces to facilitate blending of unit cell 156. For example, in some embodiments, unit cell 156 maintains a constant mass and reduced stress to increase structural and pressure capabilities. In further embodiments, structural and pressure capability remain constant and the mass is reduced.

With particular reference to FIG. 6, an example flow of first fluid 112 and second fluid 116 through a plurality of unit cells 108 is described. FIG. 6 includes an X-axis, a Y-axis, and a Z-axis for reference throughout the following description. Arrows 160 indicate the flow direction of first fluid 112 and arrows 162 indicate the flow direction of second fluid 116. Arrows 160 and arrows 162 extend in the X-direction, the Y-direction, and the Z-direction. Notably, arrows 160 extending in the Z-direction point into the drawing sheet away from the viewer and arrows 162 extending in the Z-direction point out of the drawing sheet towards the viewer.

Unit cells 108 are coupled in flow communication such that each first passageway portion 148 receives first fluid 112 from three other first passageway portions 148 and each second passageway portion 150 receives second fluid 116 from three other second passageway portions 150. In addition, each first passageway portion 148 directs first fluid 112 towards three different first passageway portions 148 and each second passageway portion 150 directs second fluid 116 toward three different second passageway portions 150. Accordingly, first fluid 112 and second fluid 116 flow in at least partially counter-flow directions. In alternate embodiments, first fluid 112 and second fluid 116 flow in any directions that enable heat exchanger 100 to operate as described herein. For example, in some embodiments, heat exchanger 100 is configured such that first fluid 112 and second fluid 116 flow in counter-flow directions, parallel-flow directions, cross-flow directions, and hybrids thereof.

Figure 7:
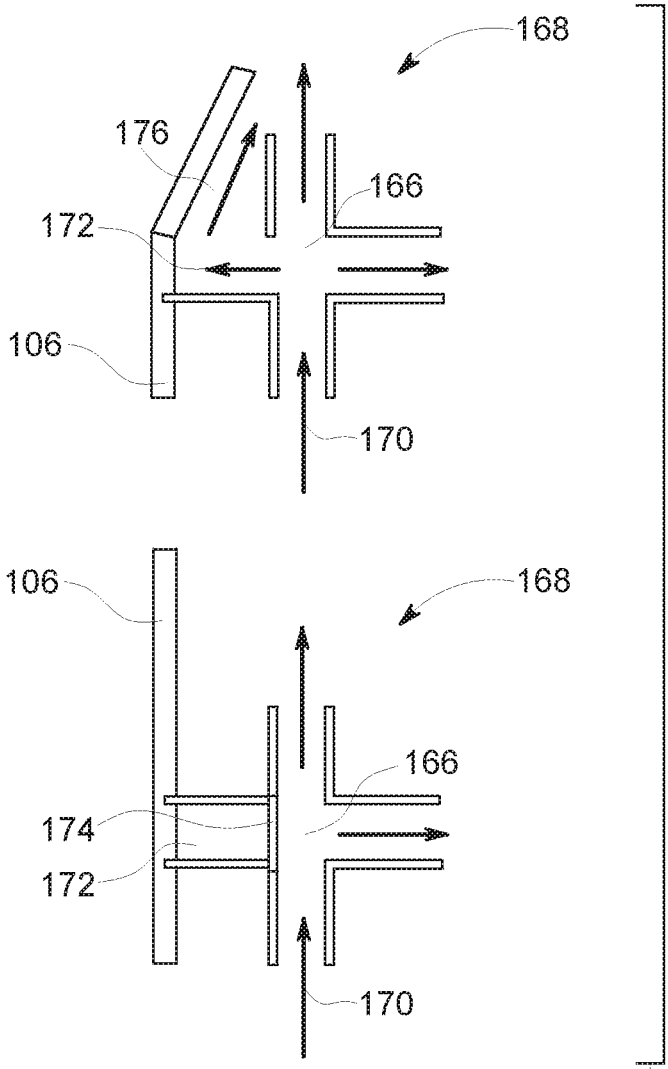
FIG. 7 is a schematic view of a plurality of exemplary flow passages adjacent a casing of the heat exchanger shown in FIG. 1.

FIG. 7 is a schematic view of flow passages 166 adjacent casing 106 of heat exchanger 100 (shown in FIG. 1). Flow passages 166 are formed by peripheral unit cells 168 such that fluid 170 flows through flow passages 166. Fluid 170 is one of first fluid 112 (shown in FIG. 1) and second fluid 116 (shown in FIG. 1). In alternative embodiments, fluid 170 is any fluid that enables heat exchanger 100 to operate as described herein. In the exemplary embodiment, flow passages 166 are configured to direct fluid 170 away from casing 106 to inhibit fluid 170 becoming trapped in a stagnant zone 172. Some flow passages 166 include a barrier 174 that inhibits fluid 170 entering stagnant zone 172. Some flow passages 166 include a channel 176 for fluid 170 to flow out of stagnant zone 172. In alternative embodiments, flow passages 166 are configured in any manner that enables heat exchanger 100 to operate as described herein. For example, in some embodiments, unit cells 168 are configured such that fluid 170 flows through a geometric flow transition, such as the 180 degree turn in redirection portion 103 (shown in FIG. 1), while maintaining heat exchange throughout at least a portion of the geometric flow transition.

In some embodiments, components of heat exchanger 100, such as core 102, are used in applications not necessarily requiring heat exchange. For example, in some embodiments, components of heat exchanger 100 are used in reactor applications, mass transfer applications, phase-change applications, and solid oxide fuel cells (SOFC). In some embodiments of SOFC systems, unit cells 108 are positioned between anode-electrolyte-cathode layers. In some embodiments of phase-change systems, unit cells 108 include sidewalls 138 having small pores (not shown) and/or engineered surfaces (not shown) to allow fluids to boil and/or condense. In alternative embodiments, heat exchanger 100 is used for any applications and/or systems that require movement of fluid.

Figure 8:
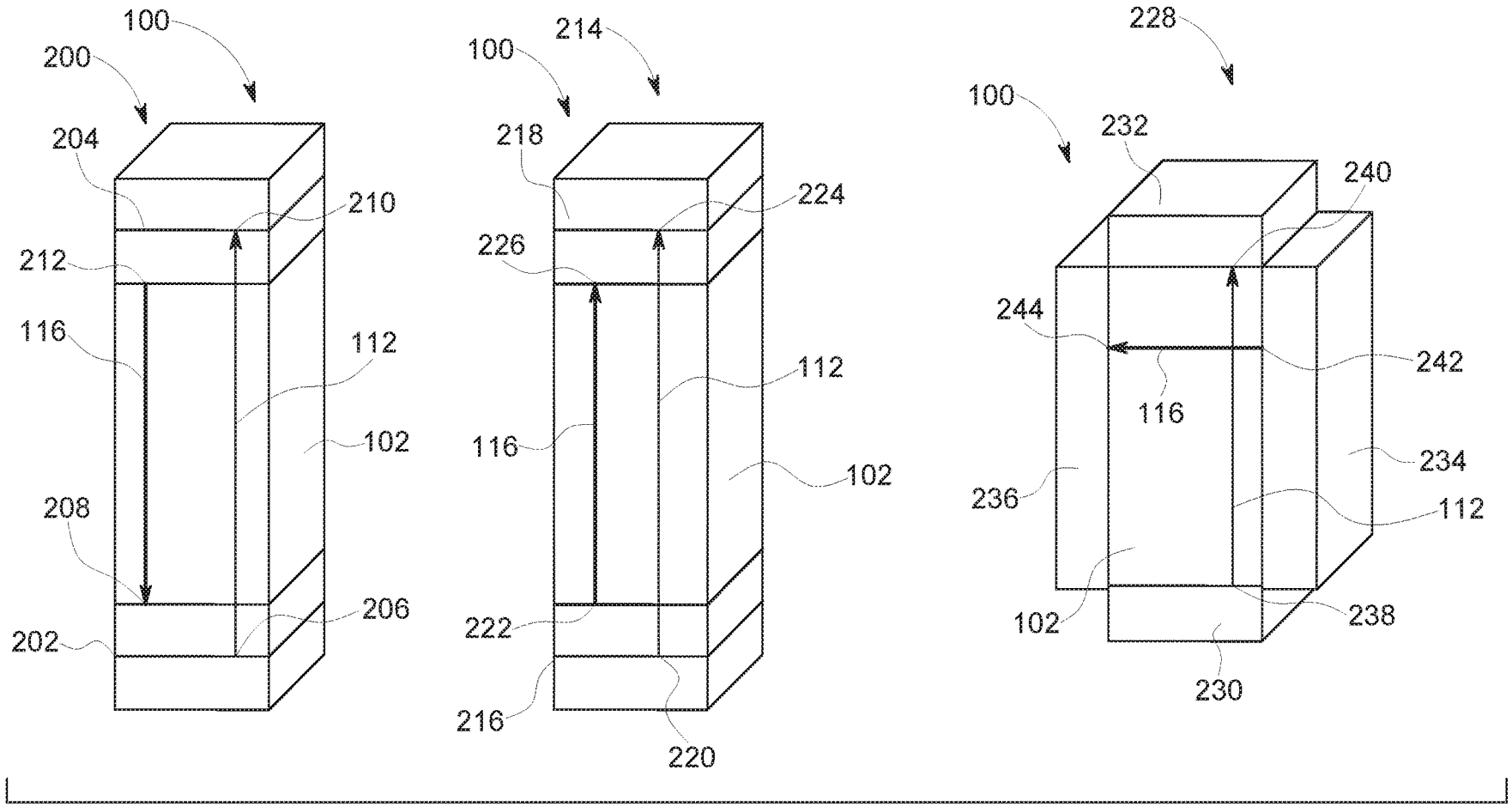
FIG. 8 is a schematic view of a plurality of exemplary flow configurations of the heat exchanger shown in FIG. 1.

FIG. 8 is a schematic view of flow configurations of heat exchanger 100. Heat exchanger 100 is configured such that first fluid 112 and second fluid 116 flow through core 102 in multiple directions. In particular, manifold portion 104 is configured and/or coupled to core 102 in different locations such that first fluid 112 and second fluid 116 are directed through core 102 in different directions. Core 102 does not have to change shape, size, and/or arrangement of unit cells 108 to accommodate different locations and configurations of manifold portions 104. Moreover, the different configurations of core 102 and manifold portion 104 enable heat exchanger 100 to meet specific system requirements, such as shape, space, and piping requirements. For example, in some embodiments, manifold portions 104 are coupled to specific locations on core 102 that enable heat exchanger 100 to fit different spaces, shapes, and/or piping connections. In further embodiments, unit cells 108 are coupled together to form core 102 having a desired shape and flow configuration. In alternative embodiments, core 102 and manifold portion 104 have any configuration that enables heat exchanger 100 to operate as described herein.

In one embodiment, heat exchanger 100 is configured such that first fluid 112 and second fluid 116 flow through core 102 in a counter-flow configuration 200. In counter-flow configuration 200, a first manifold portion 202 and a second manifold portion 204 are coupled to opposed ends of core 102. First manifold portion 202 includes a first fluid inlet 206 and a second fluid outlet 208. Second manifold portion 204 includes a first fluid outlet 210 and a second fluid inlet 212. First fluid 112 is directed through core 102 from first fluid inlet 206 toward first fluid outlet 210 and second fluid 116 is directed through core 102 from second fluid inlet 212 toward second fluid outlet 208. As a result, first fluid 112 and second fluid 116 flow through core 102 in substantially opposed directions.

In another embodiment, heat exchanger 100 is configured such that first fluid 112 and second fluid 116 flow through core 102 in a parallel-flow configuration 214. In parallel-flow configuration 214, a first manifold portion 216 and a second manifold portion 218 are coupled to opposed ends of core 102. First manifold portion 216 includes a first fluid inlet 220 and a second fluid inlet 222. Second manifold portion 218 includes a first fluid outlet 224 and a second fluid outlet 226. First fluid 112 is directed through core 102 from first fluid inlet 220 toward first fluid outlet 224 and second fluid 116 is directed through core 102 from second fluid inlet 222 toward second fluid outlet 226. As a result, first fluid 112 and second fluid 116 flow through core 102 in substantially parallel directions.

In another embodiment, heat exchanger 100 is configured such that first fluid 112 and second fluid 116 flow through core 102 in a cross-flow configuration 228. In cross-flow configuration 228, first manifold portion 230 and second manifold portion 232 are coupled to opposed ends of core 102. Third manifold portion 234 and fourth manifold portion 236 are coupled to sides of core 102. First manifold portion 230 includes a first fluid inlet 238 and second manifold portion 232 includes a first fluid outlet 240. Third manifold portion 234 includes a second fluid inlet 242 and fourth manifold portion 236 includes a second fluid outlet 244. First fluid 112 is directed through core 102 from first fluid inlet 238 towards first fluid outlet 240. Second fluid 116 is directed through core 102 from second fluid inlet 242 towards second fluid outlet 244. As a result, first fluid 112 and second fluid 116 flow through core 102 in substantially transverse directions. In particular, the flow of first fluid 112 is substantially perpendicular to the flow of second fluid 116.

Figure 9:
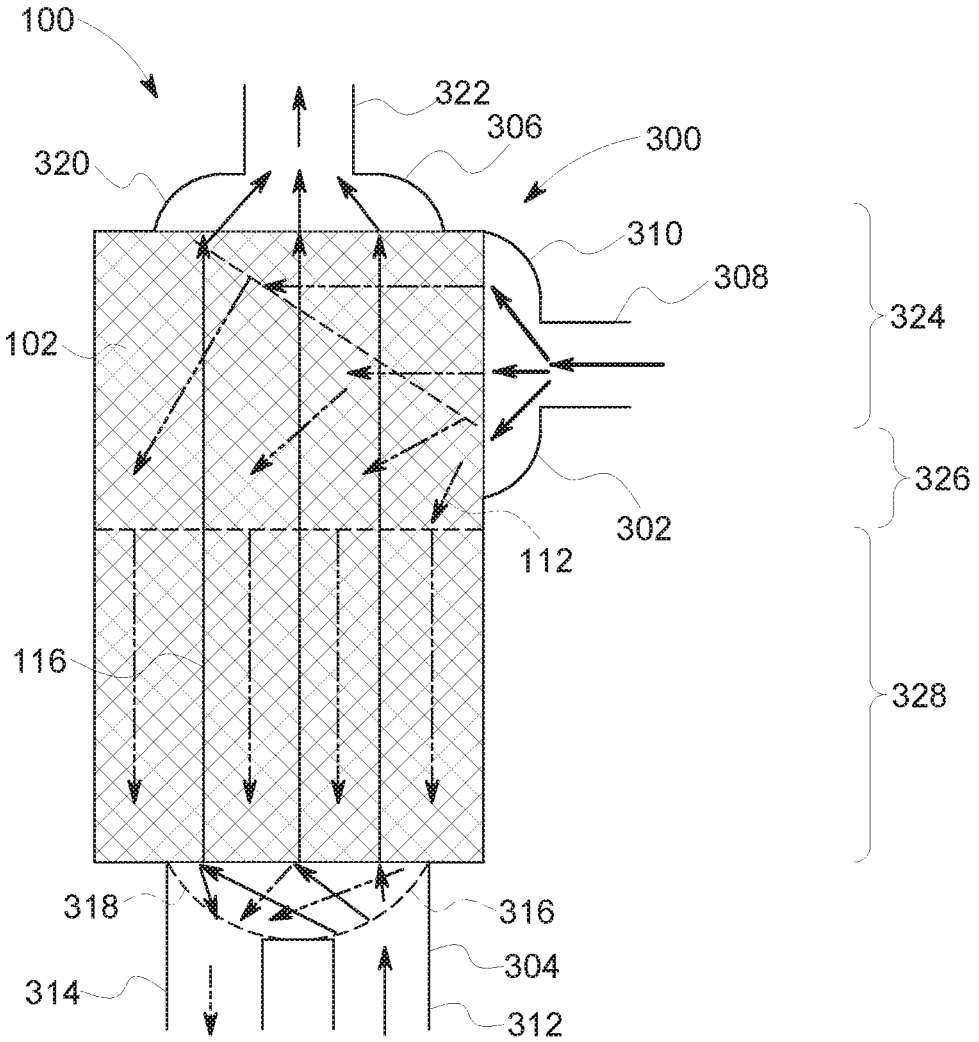
FIG. 9 is a schematic view of a hybrid counter-flow configuration of the heat exchanger shown in FIG. 1.

FIG. 9 is a schematic view of a hybrid counter-flow configuration 300 of heat exchanger 100. In hybrid counter-flow configuration 300, a first manifold portion 302 is coupled to a side of core 102. A second manifold portion 304 and a third manifold portion 306 are coupled to opposed ends of core 102. First manifold portion 302 includes a first fluid inlet 308 and a first header 310. Second manifold portion 304 includes a second fluid inlet 312, a first fluid outlet 314, a second header 316, and a third header 318. Third manifold portion 306 includes a fourth header 320 and a second fluid outlet 322. First fluid 112 is directed through core 102 from first fluid inlet 308 and first header 310 towards second header 316 and first fluid outlet 314. First fluid 112 is at least partially redirected as first fluid 112 flows through core 102. Second fluid 116 is directed through core 102 from second fluid inlet 312 and third header 318 towards fourth header 320 and second fluid outlet 322. As a result, the flow configurations of first fluid 112 and second fluid 116 vary through regions of core 102. In particular, first fluid 112 and second fluid 116 flow through a cross-flow region 324, a hybrid flow region 326, and a counter-flow region 328. In cross-flow region 324, first fluid 112 and second fluid 116 flow in substantially transverse directions. In hybrid flow region 326, the directions of flow of first fluid 112 and second fluid 116 change in relation to each other such that the flows are partially transverse and partially opposed. In hybrid flow region 326, a portion of the flows of first fluid 112 and second fluid 116 are diagonal to each other. In counter-flow region 328, first fluid 112 and second fluid 116 flow in substantially opposed directions.

Figure 10:
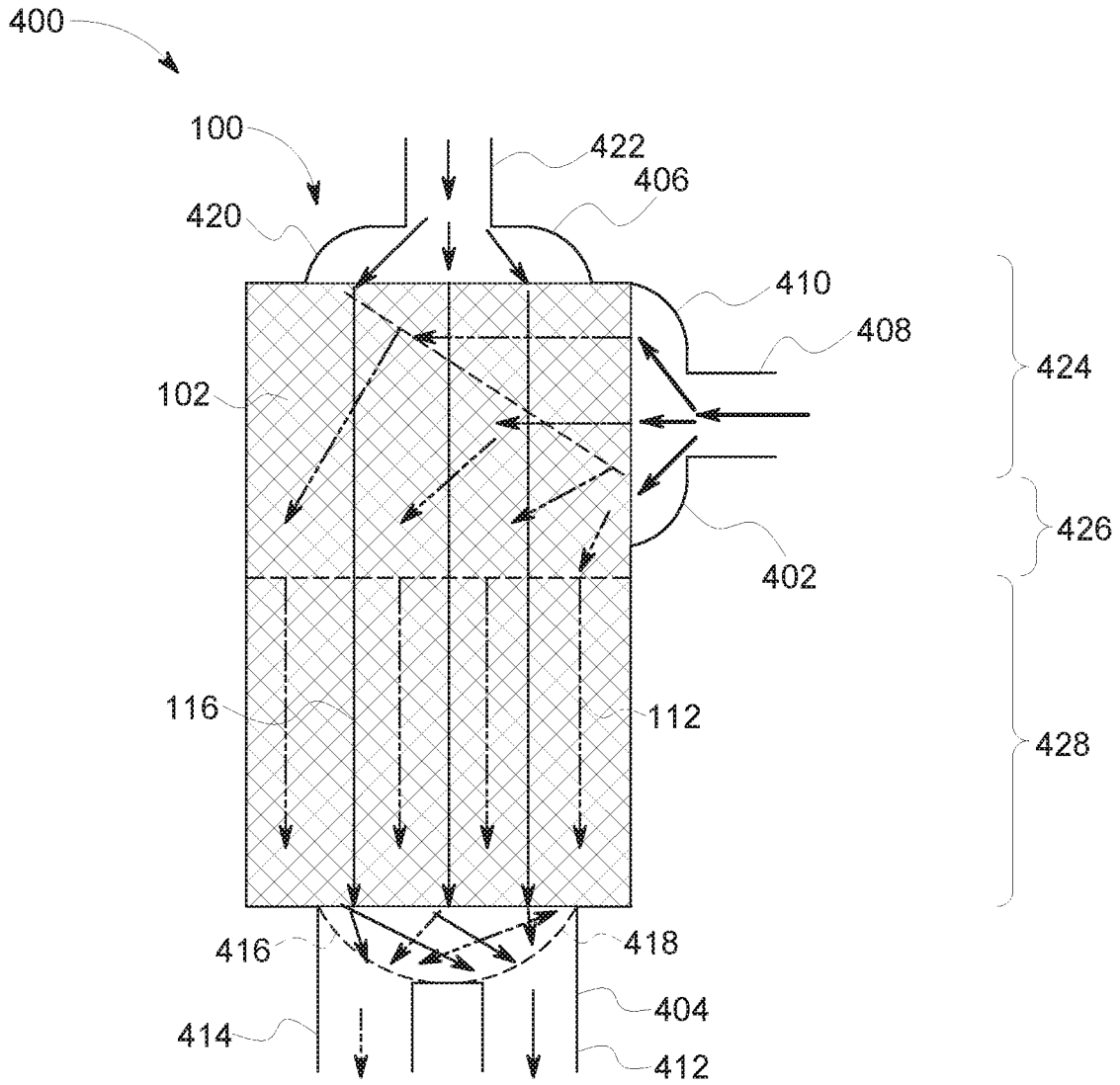
FIG. 10 is a schematic view of a hybrid parallel flow configuration of the heat exchanger shown in FIG. 1.

FIG. 10 is a schematic view of a hybrid parallel flow configuration 400 of heat exchanger 100. In hybrid parallel flow configuration 400, a first manifold portion 402 is coupled to a side of core 102. A second manifold portion 404 and a third manifold portion 406 are coupled to opposed ends of core 102. First manifold portion 402 includes a first fluid inlet 408 and a first header 410. Second manifold portion 404 includes a second fluid outlet 412, a first fluid outlet 414, a second header 416, and a third header 418. Third manifold portion 406 includes a fourth header 420 and a second fluid inlet 422. First fluid 112 is directed through core 102 from first fluid inlet 408 and first header 410 towards second header 416 and first fluid outlet 414. First fluid 112 is at least partially redirected as first fluid 112 flows through core 102. Second fluid 116 is directed through core 102 from second fluid inlet 422 and fourth header 420 towards third header 418 and second fluid outlet 412. As a result, the flow configurations of first fluid 112 and second fluid 116 vary through regions of core 102. In particular, first fluid 112 and second fluid 116 flow through a cross-flow region 424, a hybrid flow region 426, and a parallel flow region 428. In cross-flow region 424, first fluid 112 and second fluid 116 flow in substantially transverse directions.

In hybrid flow region 426, the directions of flow of first fluid 112 and second fluid 116 change in relation to each other such that the flows are partially transverse and partially parallel. In hybrid flow region 426, a portion of the flows of first fluid 112 and second fluid 116 are diagonal to each other. In parallel flow region 428, first fluid 112 and second fluid 116 flow in substantially parallel directions.

In alternative embodiments, first fluid 112 and second fluid 116 flow through core 102 in any directions that enable heat exchanger 100 to operate as described herein. For example, in some embodiments, at least one of first fluid 112 and second fluid 116 is redirected as first fluid 112 and/or second fluid 116 flows through core 102. In further embodiments, first fluid 112 and second fluid 116 flow through core 102 in any of the following flow configurations, without limitation: counter-flow, parallel flow, cross-flow, and combinations thereof. Moreover, in some embodiments, first fluid 112 and second fluid 116 flow through core 102 in any of the following directions relative to each other, without limitation: diagonal, curved, perpendicular, parallel, transverse, and combinations thereof.

Figure 11:
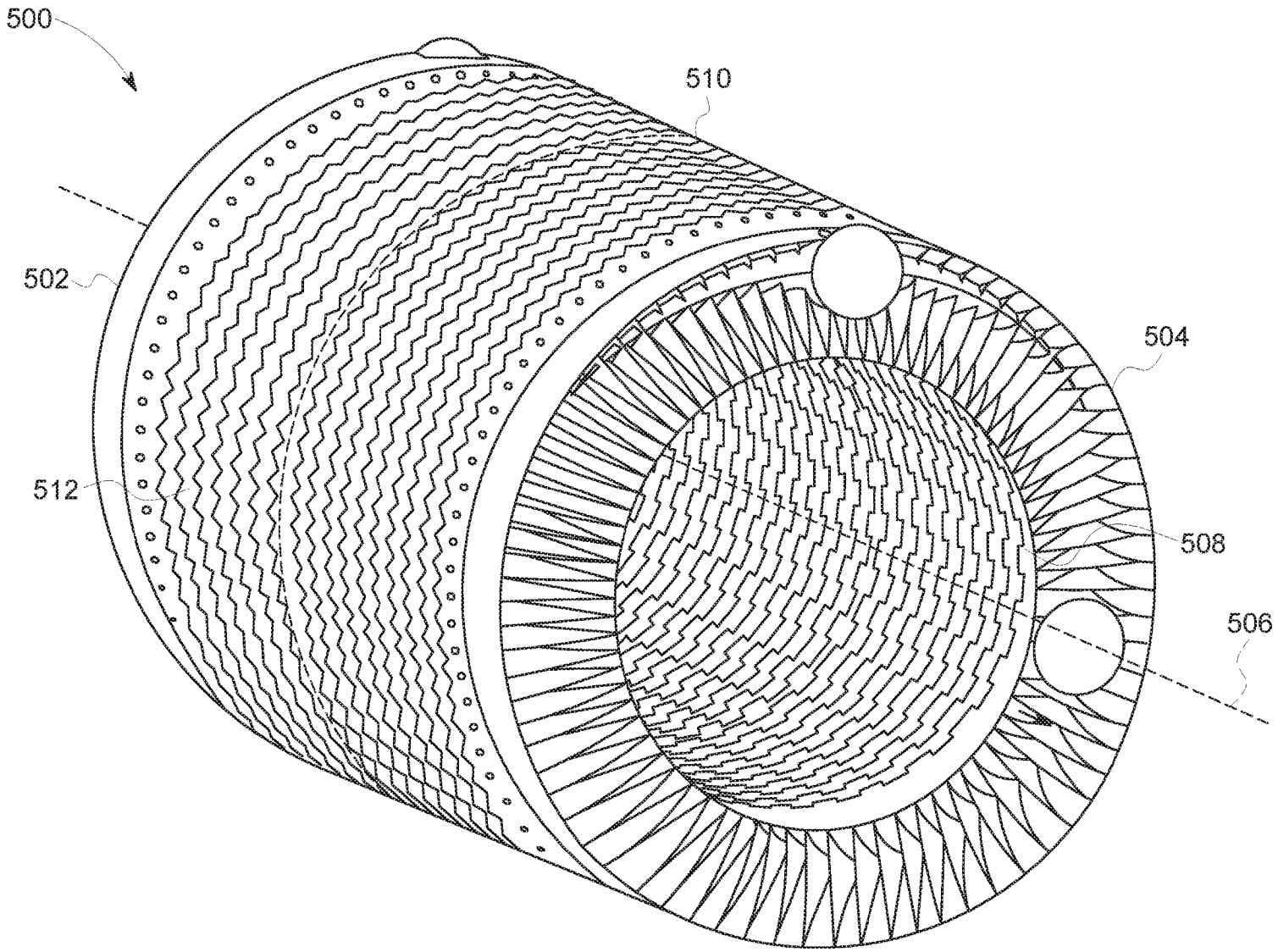
FIG. 11 is an isometric view of an exemplary heat exchanger core having an annular shape.

FIG. 11 is an isometric view of heat exchanger core 500 having an annular shape. In particular, heat exchanger core 500 forms a ring-shaped cylinder. Heat exchanger core 500 has a first end 502, a second end 504, and an axis 506 extending through first end 502 and second end 504. An inner surface 508 extends between first end 502 and second end 504 and around axis 506. An outer surface 510 extends between first end 502 and second end 504 and is spaced radially from inner surface 508. In alternative embodiments, heat exchanger core 500 has any shape that enables heat exchanger core 500 to operate as described herein. For example, in some embodiments, heat exchanger core 500 has an at least partially annular shape with an eccentric opening.

Figure 12:
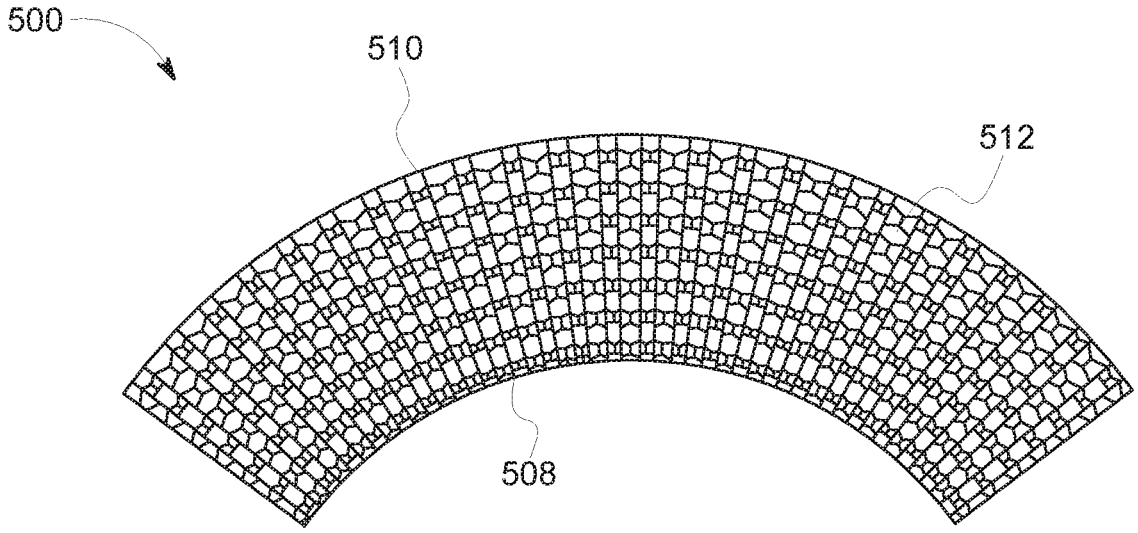
FIG. 12 is a sectional view of a portion of the heat exchanger core shown in FIG. 11.

FIG. 12 is a sectional view of a portion of heat exchanger core 500. Heat exchanger core 500 includes a plurality of unit cells 512. Unit cells 512 are arranged along an arc such that unit cells 512 maintain a constant spacing from inner surface 508 and outer surface 510. Moreover, unit cells 512 are at least partially curved. Accordingly, unit cells 512 conform to the shape of heat exchanger core 500. As a result, heat exchanger core 500 utilizes an increased amount of available space and reduces waste. In addition, unit cells 512 allow heat exchanger core 500 to have a desired shape for a specified system and/or application. In alternative embodiments, unit cells 512 are arranged in any manner and have any shapes that enable heat exchanger core 500 to operate as described herein. For example, in some embodiments, unit cells 512 are linearly arranged such that aligned unit cells 512 are not constantly spaced from inner surface 508 and outer surface 510. In further embodiments, unit cells 512 have differing shapes that facilitate unit cell 512 conforming to heat exchanger core 500.

Figure 13:
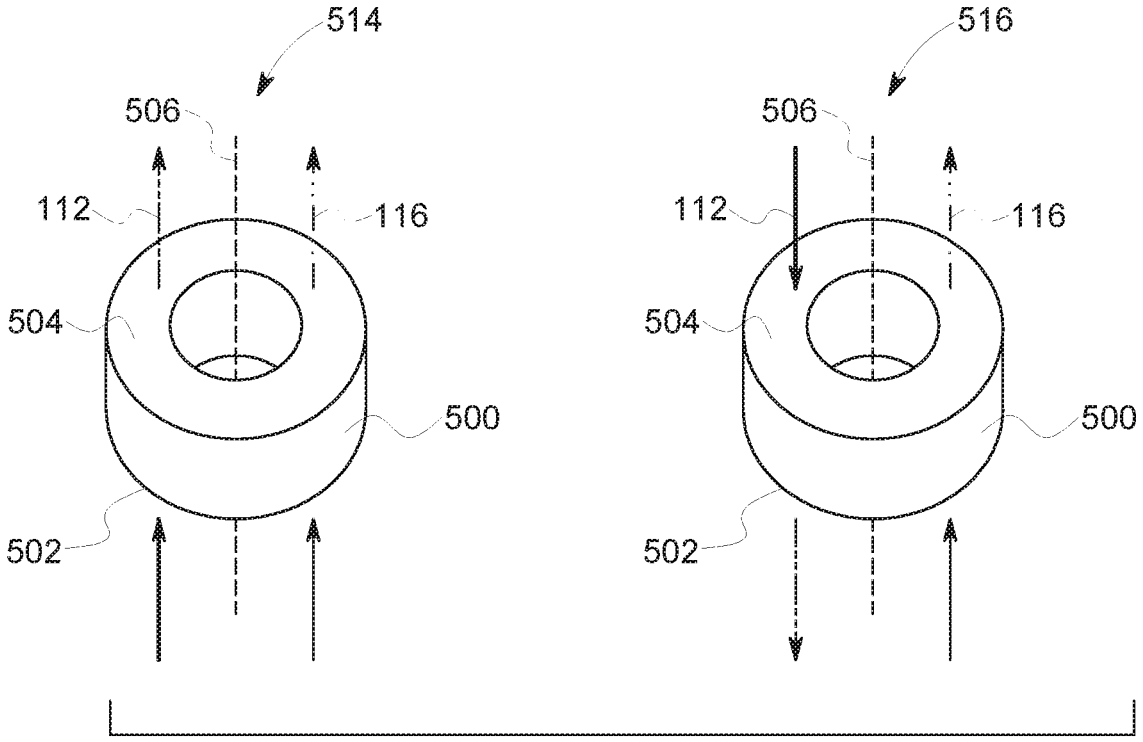
FIG. 13 is a schematic view of a plurality of exemplary flow configurations of the heat exchanger shown in FIG. 11.

FIG. 13 is a schematic view of flow configurations of heat exchanger core 500. In an axial parallel flow configuration 514, heat exchanger core 500 is configured such that first fluid 112 and second fluid 116 flow through heat exchanger core 500 from first end 502 toward second end 504. As such, first fluid 112 and second fluid 116 flow through heat exchanger core 500 in directions parallel to axis 506. In an axial counter-flow configuration 516, heat exchanger core 500 is configured such that first fluid 112 flows from second end 504 toward first end 502 and second fluid 116 flows from first end 502 toward second end 504. As such, first fluid 112 and second fluid 116 flow through heat exchanger core 500 in opposed directions parallel to axis 506.

Figure 14:
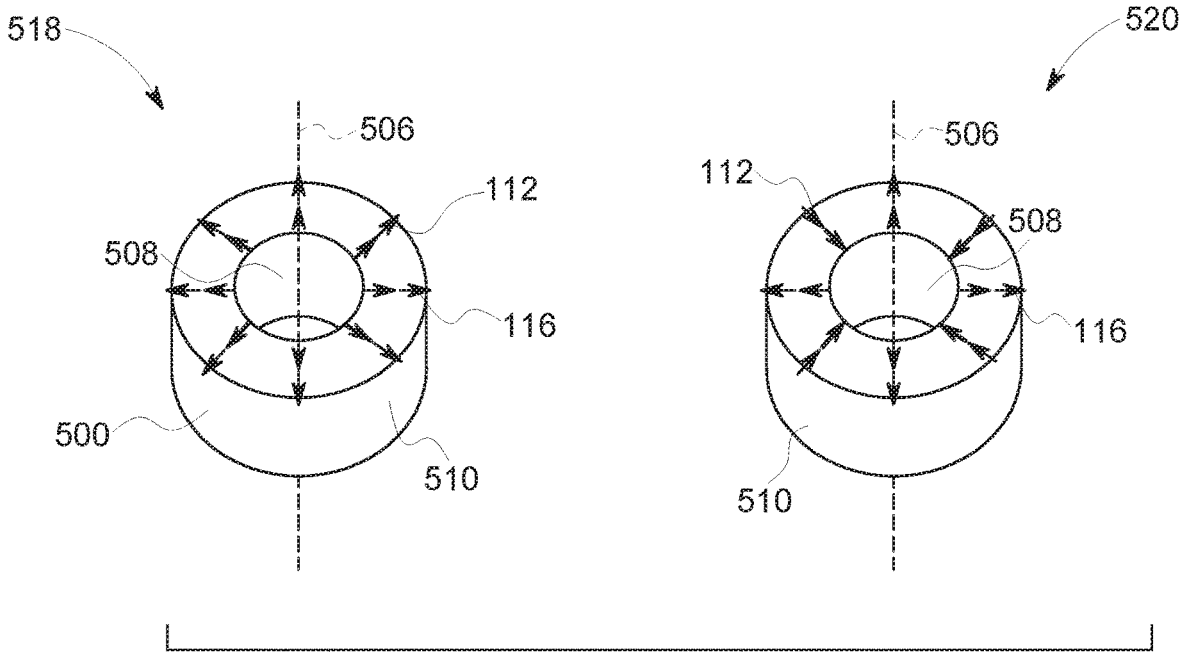
FIG. 14 is a schematic view of a plurality of exemplary radial flow configurations of the heat exchanger shown in FIG. 11.

FIG. 14 is a schematic view of radial flow configurations of heat exchanger core 500. In a radial parallel flow configuration 518, heat exchanger core 500 is configured such that first fluid 112 and second fluid 116 flow from inner surface 508 toward outer surface 510. As such, first fluid 112 and second fluid 116 flow through heat exchanger core 500 in directions that are perpendicular to axis 506. In an axial counter-flow configuration 520, heat exchanger core 500 is configured such that first fluid 112 flows from outer surface 510 toward inner surface 508 and second fluid 116 flows from inner surface 508 toward outer surface 510. As such, first fluid 112 and second fluid 116 flow through heat exchanger core 500 in opposed directions that are perpendicular to axis 506.

Figure 15:
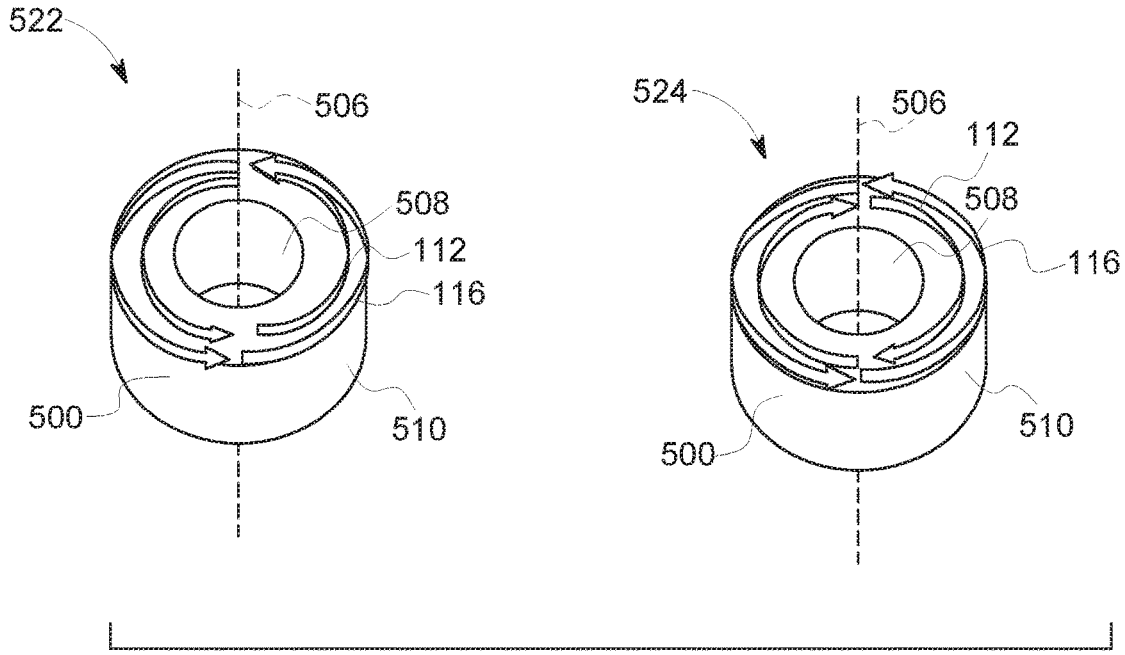
FIG. 15 is a schematic view of a plurality of exemplary circumferential flow configurations of the heat exchanger shown in FIG. 11.

FIG. 15 is a schematic view of circumferential flow configurations of heat exchanger core 500. In a circumferential parallel flow configuration 522, first fluid 112 and second fluid 116 flow through heat exchanger core 500 along at least partially curved paths between inner surface 508 and outer surface 510. In particular, first fluid 112 and second fluid 116 flow circumferentially about axis 506. In a circumferential counter-flow configuration 524, first fluid 112 and second fluid 116 flow through heat exchanger core 500 along at least partially curved paths between inner surface 508 and outer surface 510. In particular, first fluid 112 flows in a clockwise direction about axis 506 and second fluid 116 flows in a counterclockwise direction about axis 506. In alternative embodiments, first fluid 112 and second fluid 116 flow through heat exchanger core 500 in any directions that enable heat exchanger core 500 to operate as described herein. For example, in some embodiments, first fluid 112 flows in an axial direction and second fluid 116 flows in a radial direction. In further embodiments, first fluid 112 flows in an axial direction and second fluid flows in a circumferential direction. In still further embodiments, first fluid 112 flows in a radial direction and second fluid flows in a circumferential direction.

Figure 16:
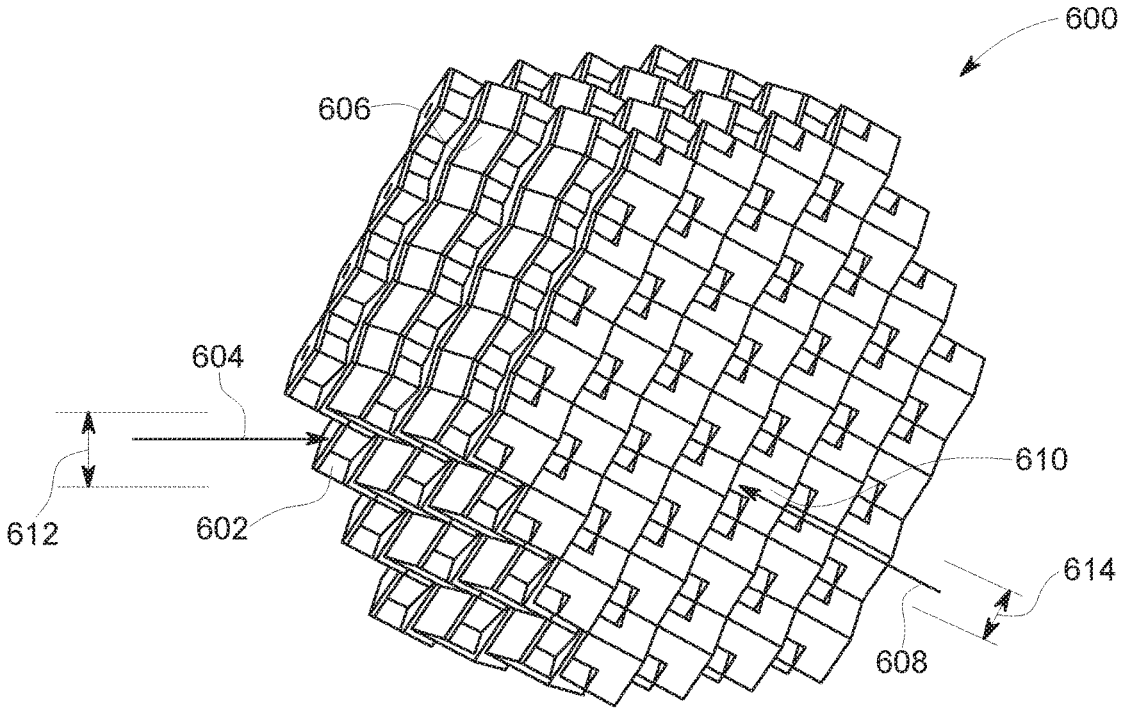
FIG. 16 is schematic view of an exemplary heat exchanger core including a passageway for gas flow.

FIG. 16 is schematic view of a heat exchanger core 600 including a first passageway 602 for gas flow 604. Heat exchanger core 600 has a hexagonal cross-sectional shape. In alternative embodiments, heat exchanger core 600 has any shape that enables heat exchanger core 600 to operate as described herein. In the exemplary embodiment, heat exchanger core 600 includes a plurality of unit cells 606 that are configured to facilitate heat exchange between gas flow 604 and another fluid such as liquid flow 608. Unit cells 606 form first passageway 602 for gas flow 604 and a second passageway 610 for liquid flow 608. First passageway 602 has a first hydraulic diameter 612 that is greater than a second hydraulic diameter 614 of second passageway 610. In some embodiments, the ratio of first hydraulic diameter 612 to second hydraulic diameter 614 is at least 2:1. In further embodiments, the ratio of first hydraulic diameter 612 to second hydraulic diameter 614 is at least 4:1. In alternative embodiments, unit cells 606 have any configuration that enables heat exchanger to operate as described herein. For example, in some embodiments, dimensions of unit cells 606, such as sidewall thickness and height, are altered to adjust the flow area available for at least one of the fluids. In further embodiments, extended surfaces such as parallel fins, helical strakes, and pin fins extend adjacent the path of gas flow 604.

Figure 17:
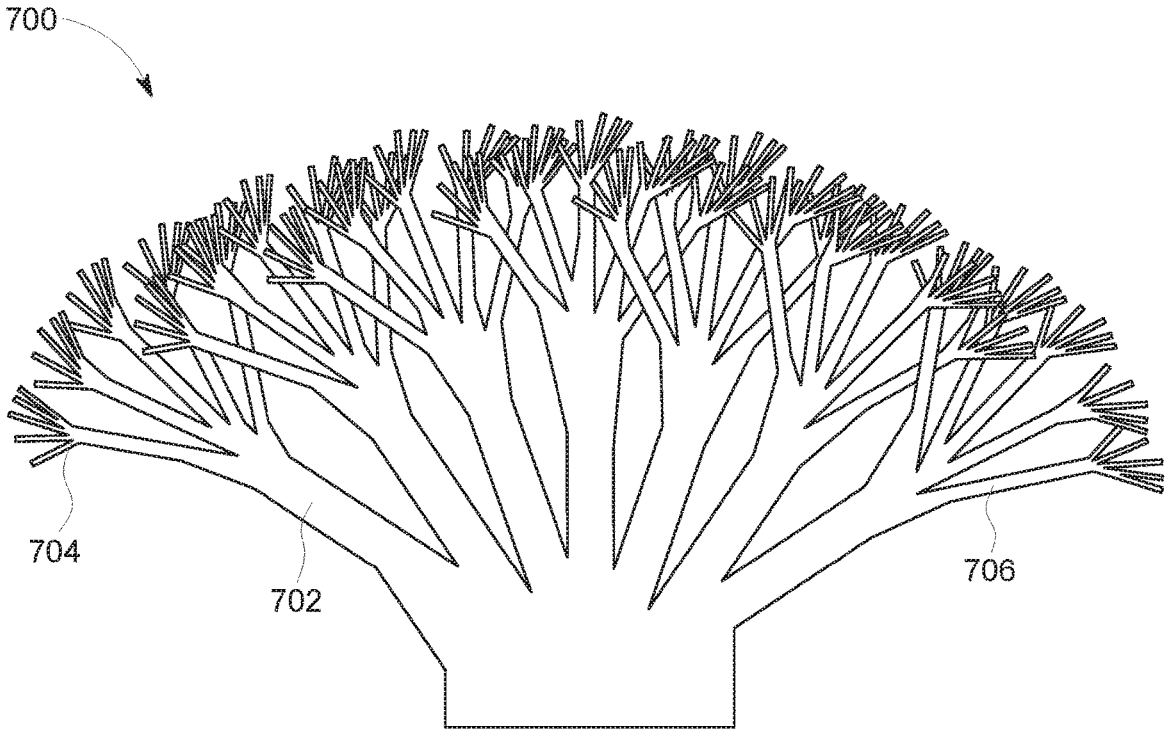
FIG. 17 is a schematic view of a tiered manifold portion for use with heat exchanger shown in FIG. 1.

FIG. 17 is a schematic view of a tiered manifold portion 700 for use with heat exchanger 100 (shown in FIG. 1). Tiered manifold portion 700 includes conduits 702 and a plurality of tiered junctions 704. The plurality of junctions 704 couple multiple conduits 702 in fluid communication such that conduits 702 define a passageway 706. As fluid flows through passageway 706, the stream of fluid is split from a relatively large inlet stream into successively smaller streams. In some embodiments, manifold portion 700 supplies first fluid 112 (shown in FIG. 2) and/or second fluid 116 (shown in FIG. 2) to core 102 (shown in FIG. 1). In further embodiments, the tiered manifold portion 700 receives first fluid 112 (shown in FIG. 2) and/or second fluid 116 (shown in FIG. 2) from core 102 (shown in FIG. 1) and progressively combines relatively small outlet streams into successively larger outlet streams for discharge from one or more outlet ports. In alternative embodiments, tiered manifold portion 700 has any configuration that enables heat exchanger 100 (shown in FIG. 1) to operate as described herein.

Figure 18:
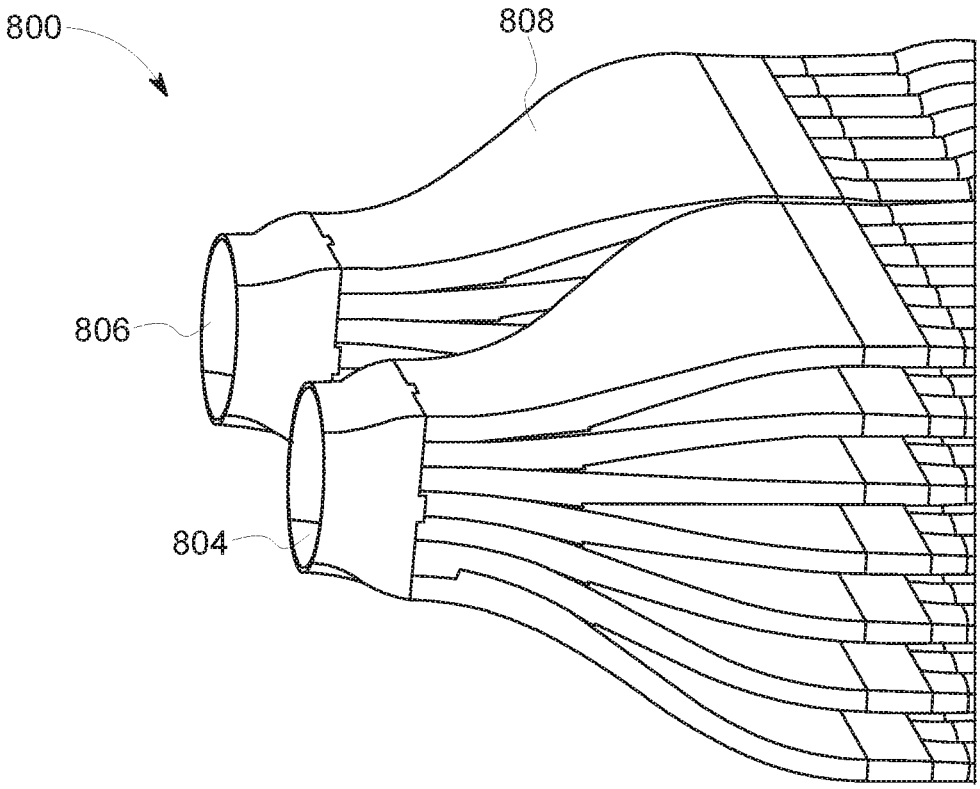
FIG. 18 is a schematic view of a planar manifold portion for use with the heat exchanger shown in FIG. 1.
Figure 19:
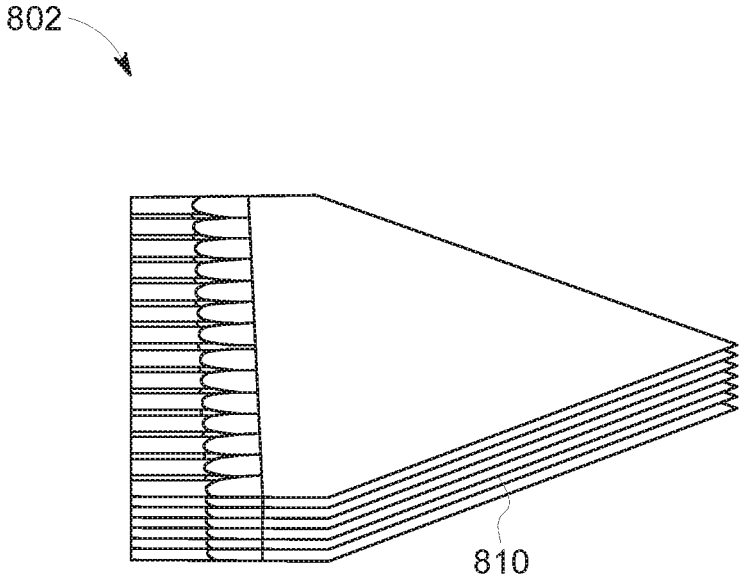
FIG. 19 is a schematic view of a planar redirection portion for use with the heat exchanger shown in FIG. 1.

FIG. 18 is a schematic view of a planar manifold portion 800 for use with heat exchanger 100. FIG. 19 is a schematic view of a planar turning portion 802 for use with heat exchanger 100. Planar manifold portion 800 includes an inlet 804, an outlet 806, and a plurality of manifold conduits 808 having a planar shape. Planar turning portion 802 includes a plurality of turn conduits 810 having a planar shape. Planar turning portion 802 is configured to redirect fluid flowing through turn conduits 810. The planar shape of manifold conduits 808 of planar manifold portion 800 and turn conduits 810 of planar turning portion 802 facilitates an even flow distribution of fluid into, through, and/or out of core 102 (shown in FIG. 1). In alternative embodiments, planar manifold portion 800 and planar turning portion 802 have any configurations that enable heat exchanger 100 (shown in FIG. 1) to operate as described herein. For example, in some embodiments, at least one of planar manifold portion 800 and planar turning portion 802 is omitted.

The above-described systems and methods include a core that enables heat exchangers to have different shapes, sizes, and flow configurations. The core includes a plurality of unit cells. The unit cells define passageways for at least two different heat exchange fluids such that the fluids combine and divide in close proximity separated only by a sidewall of the unit cell. In some embodiments, each unit cell is configured to receive flows of heat exchange fluid from at least three other unit cells such that the flows combine into a single flow. In addition, each unit cell forms a trifurcated passageway portion such that the flow divides and is discharged into at least three other unit cells. As a result, the thermal boundary layers of the heat exchange fluids are reduced and the heat exchange fluids more efficiently transfer heat through the sidewalls of the unit cells in comparison to heat exchange fluids in known heat exchangers. Moreover, the above-described heat exchangers include multiple arrangements and flow configurations to meet overall system requirements and have increased efficiency.

An exemplary technical effect of the methods, systems, and apparatus described herein includes at least one of: (a) increasing heat transfer efficiency of heat exchangers; (b) providing a heat exchanger core capable of use in multiple flow configurations; (c) providing a heat exchanger that is configured to meet system requirements such as size, shape, and piping; (d) increasing the flexibility of heat exchangers; (e) providing heat exchangers with different shapes; (f) reducing volume of heat exchangers; (g) reducing weight of heat exchangers; (h) providing a monolithic structure for use as a heat exchanger core; and (i) decreasing the size of passageways for fluid flow through heat exchanger cores.

Exemplary embodiments of a heat exchanger assembly are described above in detail. The assembly is not limited to the specific embodiments described herein, but rather, components of systems and/or steps of the methods may be utilized independently and separately from other components and/or steps described herein. For example, the configuration of components described herein may also be used in combination with other processes, and is not limited to practice with only heat exchangers and related methods as described herein. Rather, the exemplary embodiments can be implemented and utilized in connection with many applications where furcated passageways for fluid are desired.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A heat exchanger comprising:

a core defining a first passageway configured for a first fluid to flow through and a second passageway configured for a second fluid to flow through, the core comprising:

an assembly comprised of unit cells coupled together, a unit cell of the unit cells that are coupled together in the assembly having sidewalls that define first passageways into, through, and out of the unit cell with the first passageways having square cross-sectional shapes, the sidewalls of the unit cell in the unit cells that are coupled together in the assembly forming at least one inlet through which a first fluid flows into the unit cell of the unit cells that are coupled together in the assembly, the sidewalls of the unit cell in the unit cells that are coupled together in the assembly shaped to furcate flow of the first fluid inside the unit cell in the unit cells that are coupled together in the assembly into plural different outlets of the unit cell that also are formed by the sidewalls, wherein the sidewalls of the unit cell of the unit cells that are coupled together in the assembly engage the sidewalls of one or more other unit cells of the unit cells that are coupled together in the assembly to form second passageways in which a second fluid flows, the second passageways located outside of and between the unit cells that are coupled together in the assembly, the first passageways located inside of the unit cells that are coupled together in the assembly, the first passageways and the second passageways separated from each other only by the sidewalls of the unit cells that are coupled together in the assembly, wherein each of the at least one inlet and the outlets of each of the unit cells that are coupled together in the assembly has a first hydraulic diameter that is one half of a second hydraulic diameter of the second passageways.

2. The heat exchanger in accordance with claim 1, further comprising a casing, wherein the assembly is configured to conform to a shape of the casing.

3. The heat exchanger in accordance with claim 1, wherein the unit cells coupled together in the assembly are coupled in flow communication with each other such that the unit cell of the unit cells coupled together in the assembly is configured to receive the first fluid from at least three other unit cells of the assembly.

4. The heat exchanger in accordance with claim 1, wherein the assembly is configured such that the first fluid and the second fluid flow through the core in at least one of the following flow configurations: counter-flow, parallel flow, cross-flow, and hybrid flow.

5. The heat exchanger in accordance with claim 1, further comprising a first header and a second header, the first fluid flowing into the first passageway from said first header in a first direction and the second fluid flowing into the second passageway from said second header in a second direction different than the first direction.

6. The heat exchanger in accordance with claim 1, wherein said core is substantially symmetric.

7. The heat exchanger in accordance with claim 1, further comprising a casing and a peripheral unit cell adjacent said casing, said peripheral unit cell configured to direct the first fluid in a direction away from said casing to inhibit the first fluid becoming trapped in a stagnant zone.

8. The heat exchanger in accordance with claim 1, further comprising a plurality of cores.

9. The heat exchanger in accordance with claim 1, further comprising a first header coupled to the first passageway to direct the first fluid into the first passageway, said first header including a plurality of ports in flow communication with the first passageway, said first header decreasing in cross-sectional area in the direction the first fluid flows through said first header.

10. The heat exchanger in accordance with claim 9, wherein said core further defines a plenum for the second fluid to flow through, the plenum disposed adjacent said first header.

11. The heat exchanger in accordance with claim 10, further comprising a plurality of conduits coupled to said first header and extending adjacent the plenum.

12. The heat exchanger in accordance with claim 1, wherein each unit cell of the unit cells coupled together in the assembly at least partially defines the first hydraulic diameter of the first passageway and the second hydraulic diameter of the second passageway, the first hydraulic diameter different from the second hydraulic diameter.

13. A heat exchanger comprising:

a core defining a first passageway for a first fluid to flow through and a second passageway for a second fluid to flow through, the core comprising an assembly comprised of:

a first unit cell of the unit cells that are coupled together in the assembly having sidewalls that define first passageways into, through, and out of the first unit cell with the first passageways having square cross-sectional shapes, the sidewalls of the first unit cell in the unit cells that are coupled together in the assembly forming at least one inlet through which a first fluid flows into the first unit cell of the unit cells that are coupled together in the assembly, the sidewalls of the first unit cell in the unit cells that are coupled together in the assembly shaped to furcate flow of the first fluid inside the first unit cell in the unit cells that are coupled together in the assembly into plural different outlets of the first unit cell that also are formed by the sidewalls;

a second unit cell of the unit cells coupled together in the assembly coupled to the first unit cell of the unit cells coupled together in the assembly; and a third unit cell of the unit cells coupled together in the assembly coupled to the first unit cell of the unit cells coupled together in the assembly, wherein the sidewalls of the unit cells that are coupled together in the assembly engage the sidewalls of one or more other unit cells of the unit cells that are coupled together in the assembly to form second passageways in which a second fluid flows, the second passageways located outside of and between the unit cells that are coupled together in the assembly, the first passageways located inside of the unit cells that are coupled together in the assembly, the first passageways and the second passageways separated from each other only by the sidewalls of the unit cells that are coupled together in the assembly, wherein each of the at least one inlet and the outlets of each of the unit cells that are coupled together in the assembly have a first hydraulic diameter that is one half of a second hydraulic diameter of the second passageways.

14. The heat exchanger in accordance with claim 13, wherein said core further comprises a first header and a second header, said first header configured for the first fluid to flow from said first header into the first passageway in a first direction, said second header configured for the second fluid to flow from said second header into the second passageway in a second direction transverse to the first direction.

15. The heat exchanger in accordance with claim 13, wherein said core further comprises a first header and a second header, said first header configured for the first fluid to flow from said first header into the first passageway in a first direction, said second header configured for the second fluid to flow from said second header into the second passageway in a second direction parallel to the first direction.

16. The heat exchanger in accordance with claim 13, wherein said first unit cell of the unit cells coupled together in the assembly comprises the sidewalls defining at least three of the plural different outlets for the second fluid to exit a second passageway first portion.

17. The heat exchanger in accordance with claim 1, wherein the unit cells coupled together in the assembly are configured to receive flows of the first fluid from at least three other unit cells of the unit cells coupled together in the assembly such that the flows of the first fluid combine into a single flow of the first fluid.

18. The heat exchanger in accordance with claim 13, further comprising a first header coupled to the first passageway to direct the first fluid into the first passageway, the first header including a plurality of ports in flow communication with the first passageway, the first header decreasing in cross-sectional area in the direction the first fluid flows through the first header.

19. A heat exchanger comprising:

a core defining a first passageway configured for a first fluid to flow through and a second passageway configured for a second fluid to flow through, the core comprising:

an assembly comprised of unit cells coupled together, a unit cell of the unit cells that are coupled together in the assembly having sidewalls that define first passageways into, through, and out of the unit cell with the first passageways having square cross-sectional shapes, the sidewalls of the unit cell in the unit cells that are coupled together in the assembly forming at least one inlet through which a first fluid flows into the unit cell of the unit cells that are coupled together in the assembly, the sidewalls of the unit cell in the unit cells that are coupled together in the assembly shaped to furcate flow of the first fluid inside the unit cell in the unit cells that are coupled together in the assembly into plural different outlets of the unit cell that also are formed by the sidewall, wherein the sidewalls of the unit cell of the unit cells that are coupled together in the assembly engage the sidewalls of one or more other unit cells of the unit cells that are coupled together in the assembly to form second passageways in which a second fluid flows, the second passageways located outside of and between the unit cells that are coupled together in the assembly, the first passageways located inside of the unit cells that are coupled together in the assembly, the first passageways and the second passageways separated from each other only by the sidewalls of the unit cells that are coupled together in the assembly, wherein each of the at least one inlet and the outlets of each of the unit cells that are coupled together in the assembly have a first hydraulic diameter that is one half of a second hydraulic diameter of the second passageways, wherein the core further comprises a first header and a second header, the first header configured for the first fluid to flow from the first header into the first passageway in a first direction, the second header configured for the second fluid to flow from the second header into the second passageway in a second direction transverse to the first direction.

20. The heat exchanger in accordance with claim 19, further comprising the first header coupled to the first passageway to direct the first fluid into the first passageway, the first header including a plurality of ports in flow communication with the first passageway, the first header decreasing in cross-sectional area in the direction the first fluid flows through the first header.

* * * * *